US011189955B2

(12) United States Patent
Aoki et al.

(10) Patent No.: US 11,189,955 B2
(45) **Date of Patent: *Nov. 30, 2021**

(54) CONNECTOR HAVING HOUSING AND SEALING MEMBER

(71) Applicant: Yazaki Corporation, Tokyo (JP)

(72) Inventors: Eiji Aoki, Shizuoka (JP); Kazuhide Takahashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/941,612

(22) Filed: Jul. 29, 2020

(65) Prior Publication Data

US 2021/0036457 A1 Feb. 4, 2021

(30) Foreign Application Priority Data

Jul. 29, 2019 (JP) ..... JP2019-138464

(51) Int. Cl.
*H01R 13/52* (2006.01)
*H01R 13/42* (2006.01)
(Continued)

(52) U.S. Cl.
CPC ..... *H01R 13/5202* (2013.01); *H01R 12/58* (2013.01); *H01R 13/42* (2013.01);
(Continued)

(58) Field of Classification Search
CPC .. H01R 13/5202; H01R 13/42; H01R 13/502; H01R 13/521; H01R 12/58
See application file for complete search history.

(56) References Cited

U.S. PATENT DOCUMENTS 8,328,572 B2 * 12/2012 Tashiro ..... H01R 13/5208 439/271
9,033,734 B2 * 5/2015 Tanaka ..... H01R 13/6592 439/587
(Continued)

FOREIGN PATENT DOCUMENTS

JP 2014-93248 A 5/2014
JP 2014-135131 A 7/2014
(Continued)

*Primary Examiner* — Abdullah A Riyami
*Assistant Examiner* — Nader J Alhawamdeh
(74) *Attorney, Agent, or Firm* — Kenealy Vaidya LLP

(57) ABSTRACT

A connector includes an insulating housing that is fixed to a casing of a first device, a plurality of conductors to electrically connect the first device and the second device, an insulating sealing member that includes a plurality of annular sealing parts that seal between the conductors and the housing and a connecting part that connects the sealing parts, and an insulating support member that includes second through holes into which the conductors are inserted, is attached to the housing from a side of the second device, and supports the sealing parts. The housing and the sealing member have a first fitting structure in which they are fitted to each other along an axial direction of the conductor, and the sealing member and the support member have a second fitting structure in which they are fitted to each other along the axial direction of the conductor.

7 Claims, 31 Drawing Sheets

(51) Int. Cl.
*H01R 12/58* (2011.01)
*H01R 13/502* (2006.01)
*H01R 107/00* (2006.01)

(52) U.S. Cl.
CPC ..... *H01R 13/502* (2013.01); *H01R 13/521* (2013.01); *H01R 2107/00* (2013.01)

(56) References Cited

U.S. PATENT DOCUMENTS

| | | | | |
|---|---|---|---|---|
| 9,397,440 | B2 * | 7/2016 | Mori | H01R 13/405 |
| 9,484,647 | B2 * | 11/2016 | Ishikawa | H01R 9/24 |
| 9,524,811 | B2 * | 12/2016 | Adachi | B60R 16/0215 |
| 9,966,715 | B2 * | 5/2018 | Ishibashi | H01R 13/512 |
| 11,063,387 | B2 * | 7/2021 | Aoki | H01R 13/5216 |
| 2013/0140055 | A1 * | 6/2013 | Adachi | B60R 16/0215 174/113 R |
| 2015/0118905 | A1 * | 4/2015 | Mori | H01R 13/52 439/606 |
| 2015/0214655 | A1 * | 7/2015 | Mori | H01R 13/504 439/606 |
| 2016/0172784 | A1 * | 6/2016 | Kataoka | H01R 13/6592 439/271 |
| 2018/0358748 | A1 * | 12/2018 | Yamanashi | H01R 24/62 |
| 2019/0379154 | A1 * | 12/2019 | Nishijima | H01R 13/512 |
| 2021/0036458 | A1 * | 2/2021 | Aoki | H01R 13/42 |
| 2021/0044052 | A1 * | 2/2021 | Takahashi | H01R 13/5202 |
| 2021/0044053 | A1 * | 2/2021 | Aoki | H01R 13/502 |
| 2021/0091507 | A1 * | 3/2021 | Aoki | H01R 9/16 |

FOREIGN PATENT DOCUMENTS

| | | | |
|---|---|---|---|
| JP | 2018-116896 | A | 7/2018 |
| JP | 2018-125078 | A | 8/2018 |

* cited by examiner

CONNECTOR HAVING HOUSING AND SEALING MEMBER

CROSS-REFERENCE TO RELATED APPLICATION(S)

The present application claims priority to and incorporates by reference the entire contents of Japanese Patent Application No. 2019-138464 filed in Japan on Jul. 29, 2019.

BACKGROUND OF THE INVENTION

1. Field of the Invention

The present invention relates to a connector.

2. Description of the Related Art

In the related art, a connector having a sealing member is known. Patent Literature 1 discloses a technology of a connector including a main housing retaining a main terminal for relaying a main circuit, an electric wire with a connector including an electric wire for relaying a sub-circuit and a sub-connector connected to a terminal of the electric wire, and an electric wire retention part connecting with the main housing and retaining the electric wire.

In the connector of Japanese Patent Application Laid-open No. 2018-116896, the electric wire and the electric wire retention part are sealed by a potting material or a rubber stopper.

It is desired to improve the work efficiency of assembling a connector having a plurality of conductors and a sealing member. For example, when the connector is configured to be compatible with a plurality of assembling methods, it is possible to employ the most efficient assembling method for the environment and operators.

SUMMARY OF THE INVENTION

An object of the present invention is to provide a connector capable of improving the efficiency of assembly work.

In order to solve the above mentioned problem and achieve the object, a connector according to one aspect of the present invention includes an insulating housing that is fixed to a casing of a first device at a communication part through which an opening of the casing of the first device and an opening of a casing of a second device communicate with each other, and includes a plurality of first through holes that allow an internal space of the first device and an internal space of the second device to communicate with each other; a plurality of conductors that are inserted into the first through holes, to electrically connect the first device and the second device; an insulating sealing member that includes a plurality of annular sealing parts that seal between the conductors and the housing, and a connecting part that connects the sealing parts; and an insulating support member that includes second through holes into which the conductors are inserted, is attached to the housing from a side of the second device, and interposes the sealing member between the support member and the housing to support the sealing parts, wherein the housing and the sealing member have a first fitting structure in which the housing and the sealing member are fitted to each other along an axial direction of the conductor, and the sealing member and the support member have a second fitting structure in which the sealing member and the support member are fitted to each other along the axial direction of the conductor.

According to another aspect of the present invention, in the connector, it is preferable that the connecting part has an annular frame part that surrounds the conductors, and the first fitting structure has the frame part and a recess provided in the housing and fitted to the frame part.

According to still another aspect of the present invention, in the connector, it is preferable that the second fitting structure has recesses provided in the connecting part and protrusions provided in the support member and fitted into the recesses of the connecting part, and the protrusions support the sealing parts.

According to still another aspect of the present invention, in the connector, it is preferable that the connector includes metal plates fixed to the support member, wherein the conductors are inserted into some first through holes of the plurality of first through holes, the metal plates are inserted into the first through holes different from the first through holes into which the conductors are inserted, in each of the conductors, a part protruding from the first through hole is fixed to the housing by a fastening member together with a terminal of the first device, and in each of the metal plates, a part protruding from the first through hole is fixed to the housing by a fastening member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a connector according to an embodiment of the present invention will be described in detail with reference to the drawings. Note that the invention is not limited to the embodiment. Furthermore, the components in the following embodiments include those that can be easily arrived at by a person skilled in the art or those that are substantially the same.

Embodiment

Figure 1:
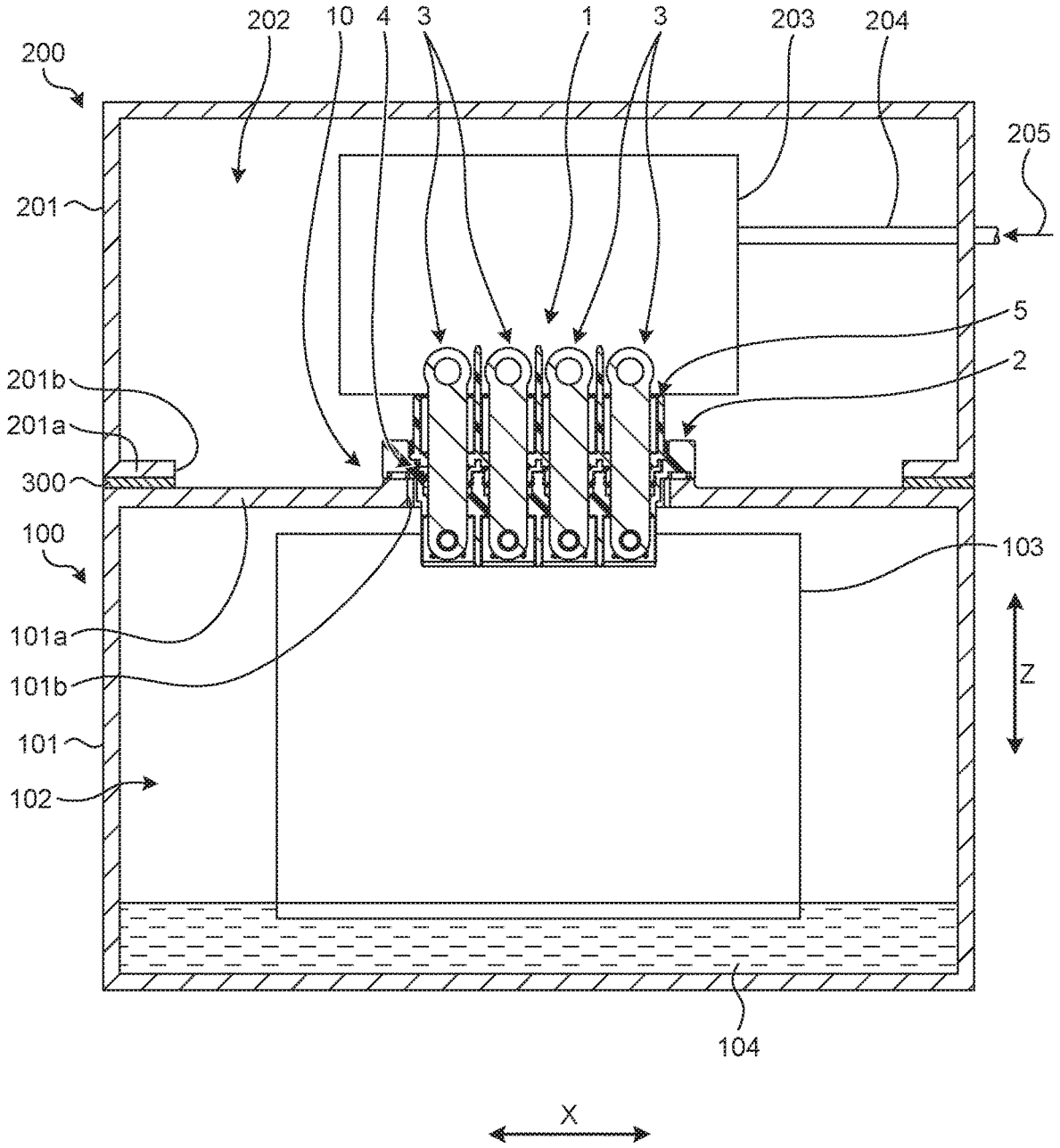
FIG. 1 is a sectional view of a connector, a first device, and a second device according to an embodiment.
Figure 2:
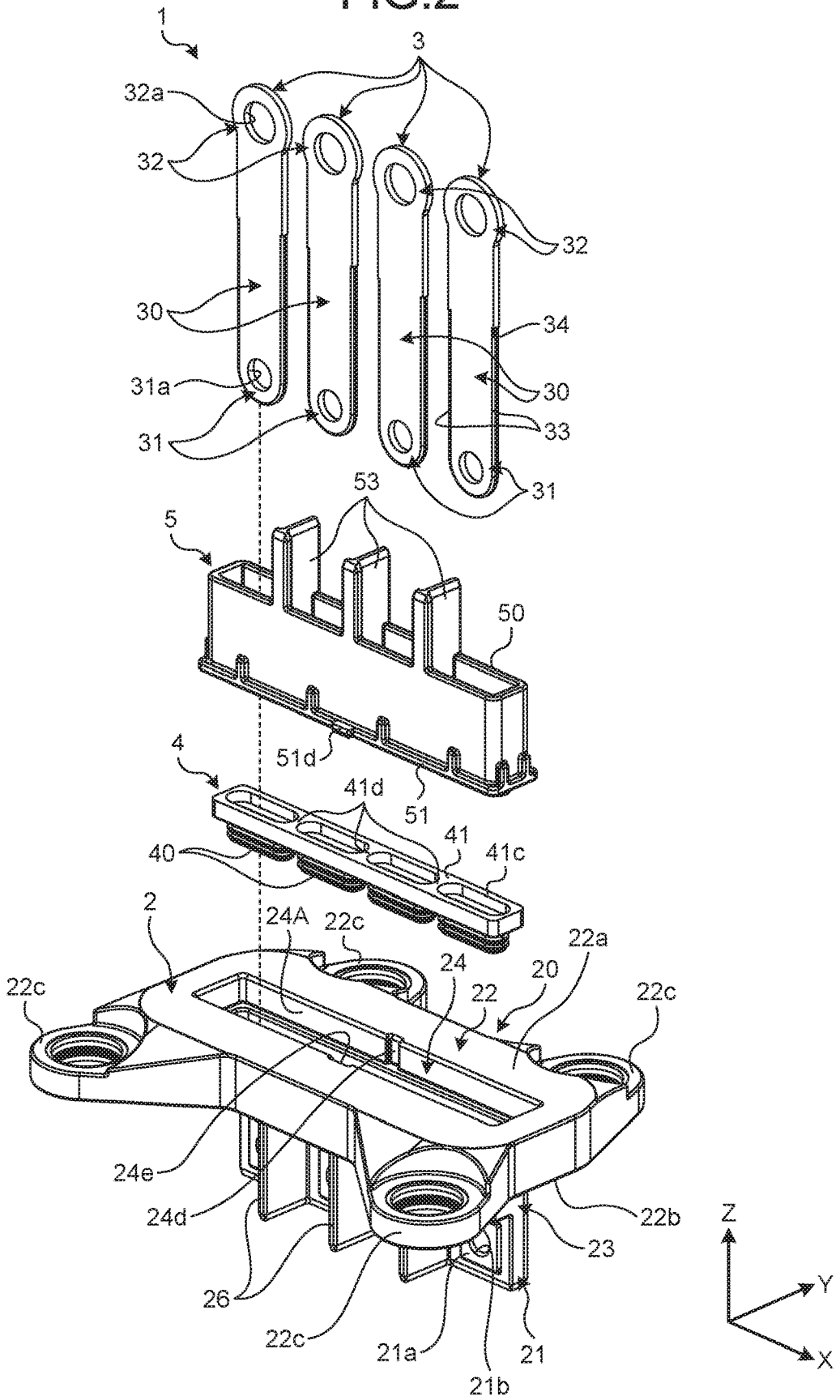
FIG. 2 is an exploded perspective view of the connector according to the embodiment.
Figure 4:
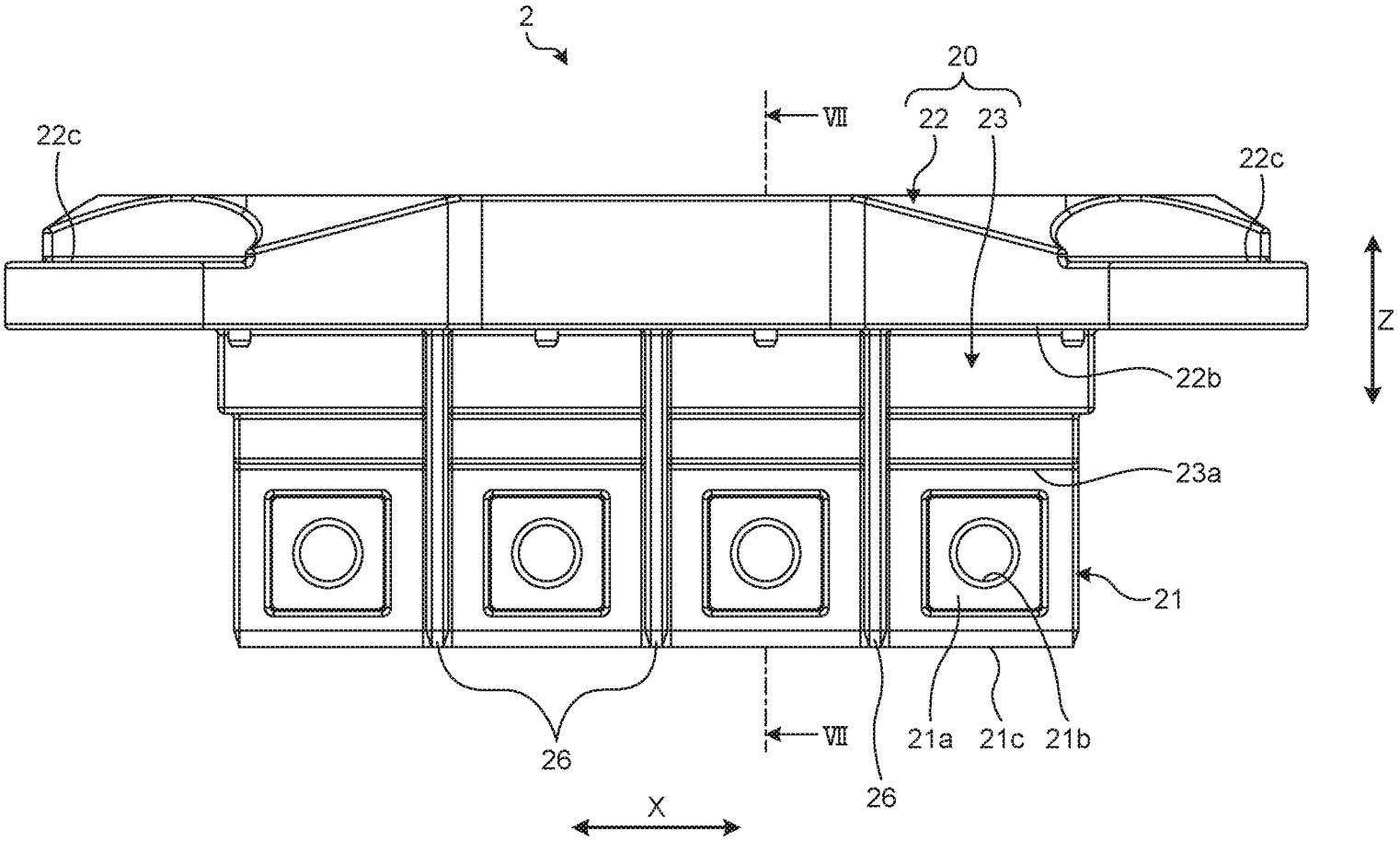
FIG. 4 is a front view of the housing according to the embodiment.
Figure 5:
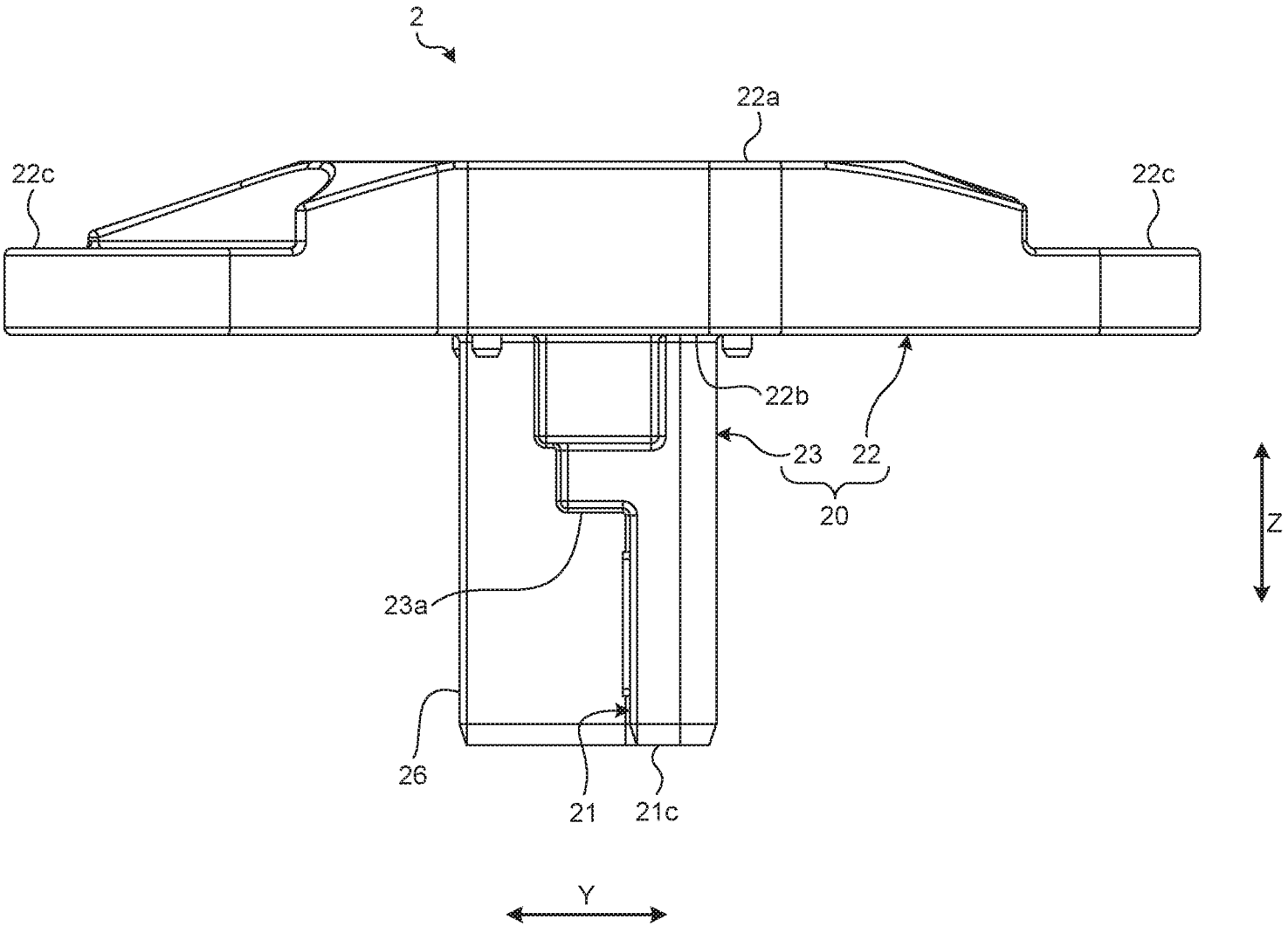
FIG. 5 is a side view of the housing according to the embodiment.
Figure 7:
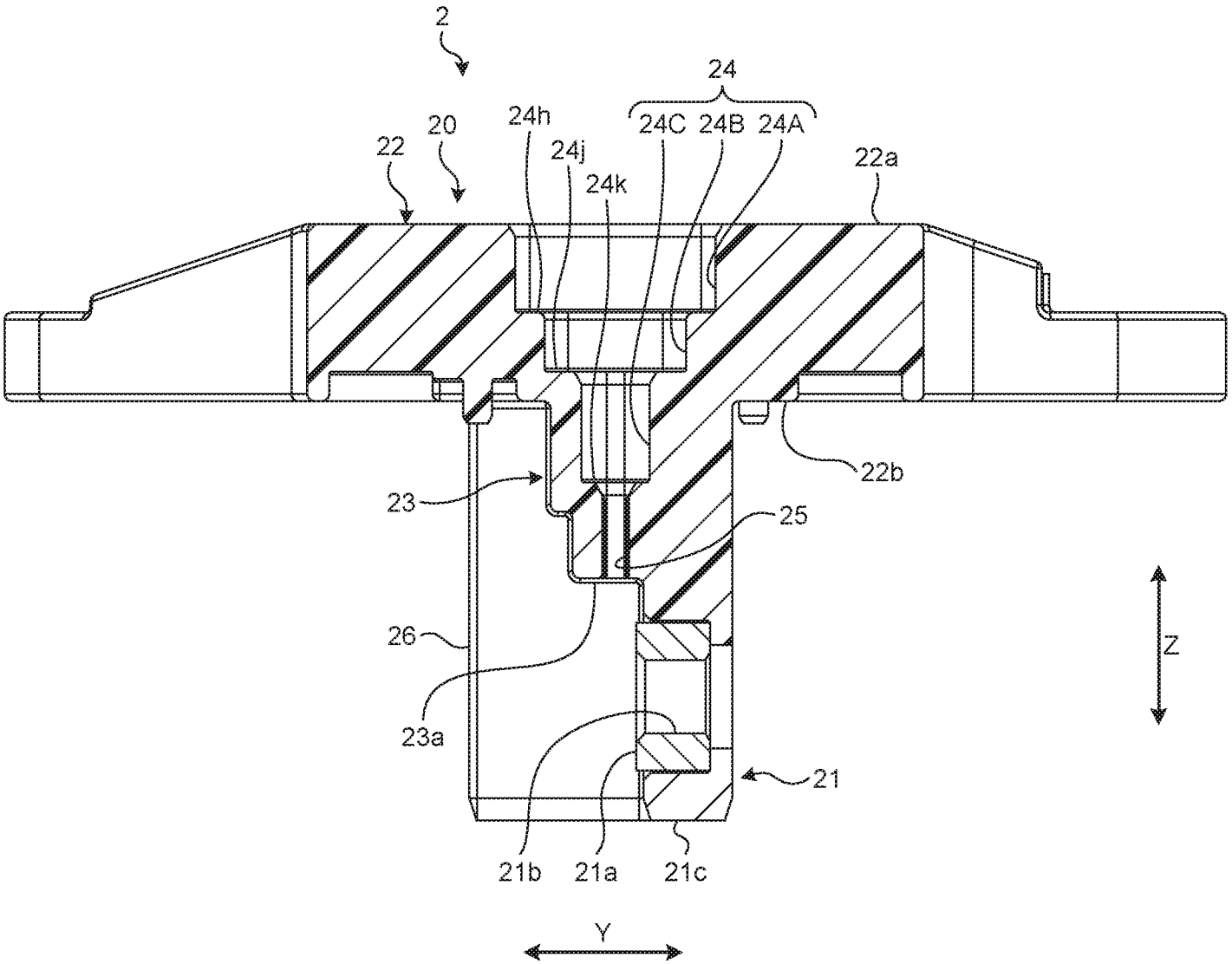
FIG. 7 is another sectional view of the housing according to the embodiment.
Figure 8:
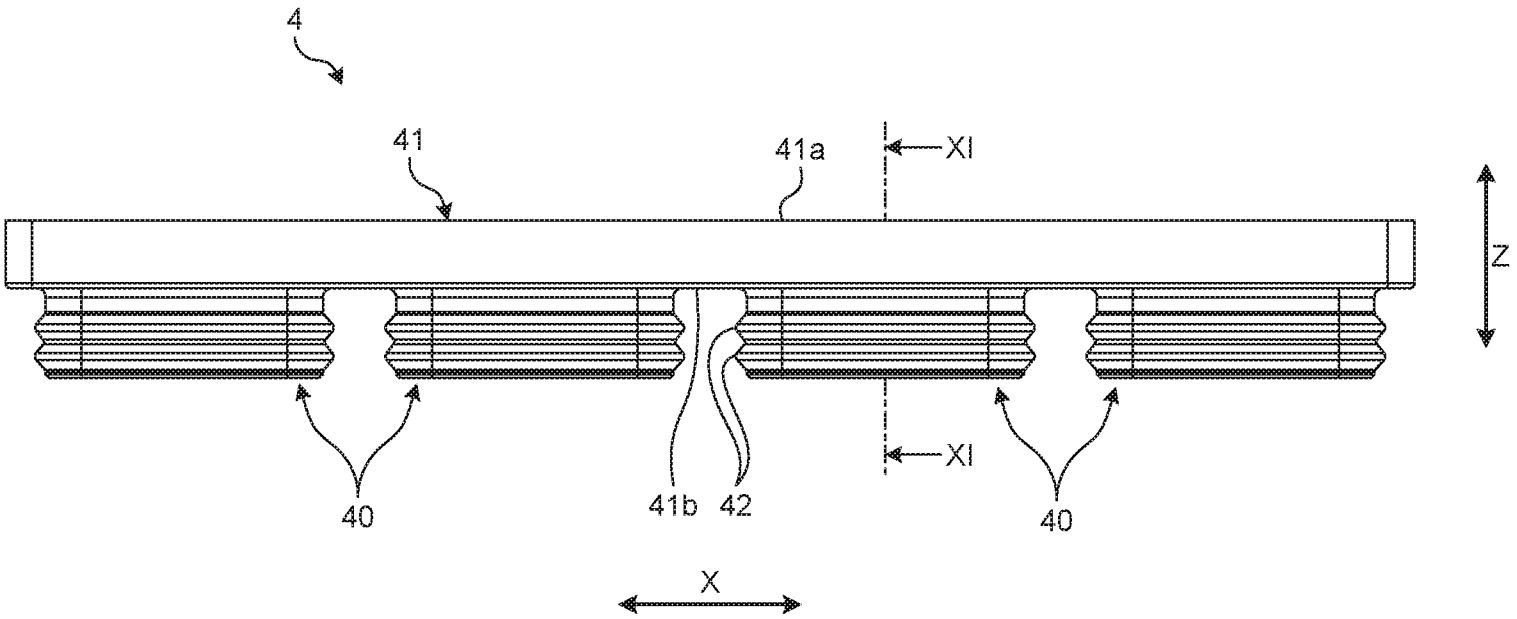
FIG. 8 is a front view of a sealing member according to the embodiment.
Figure 9:
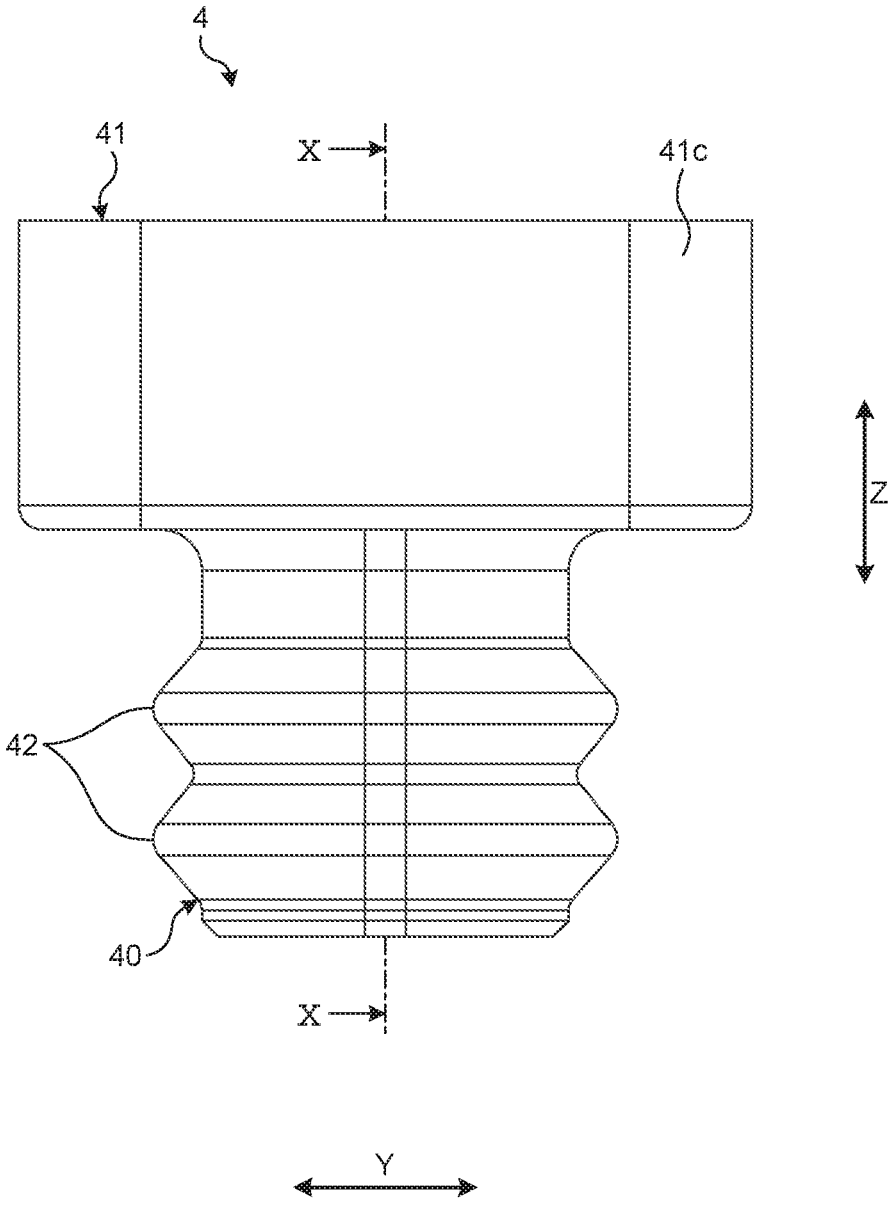
FIG. 9 is a side view of the sealing member according to the embodiment.
Figure 10:
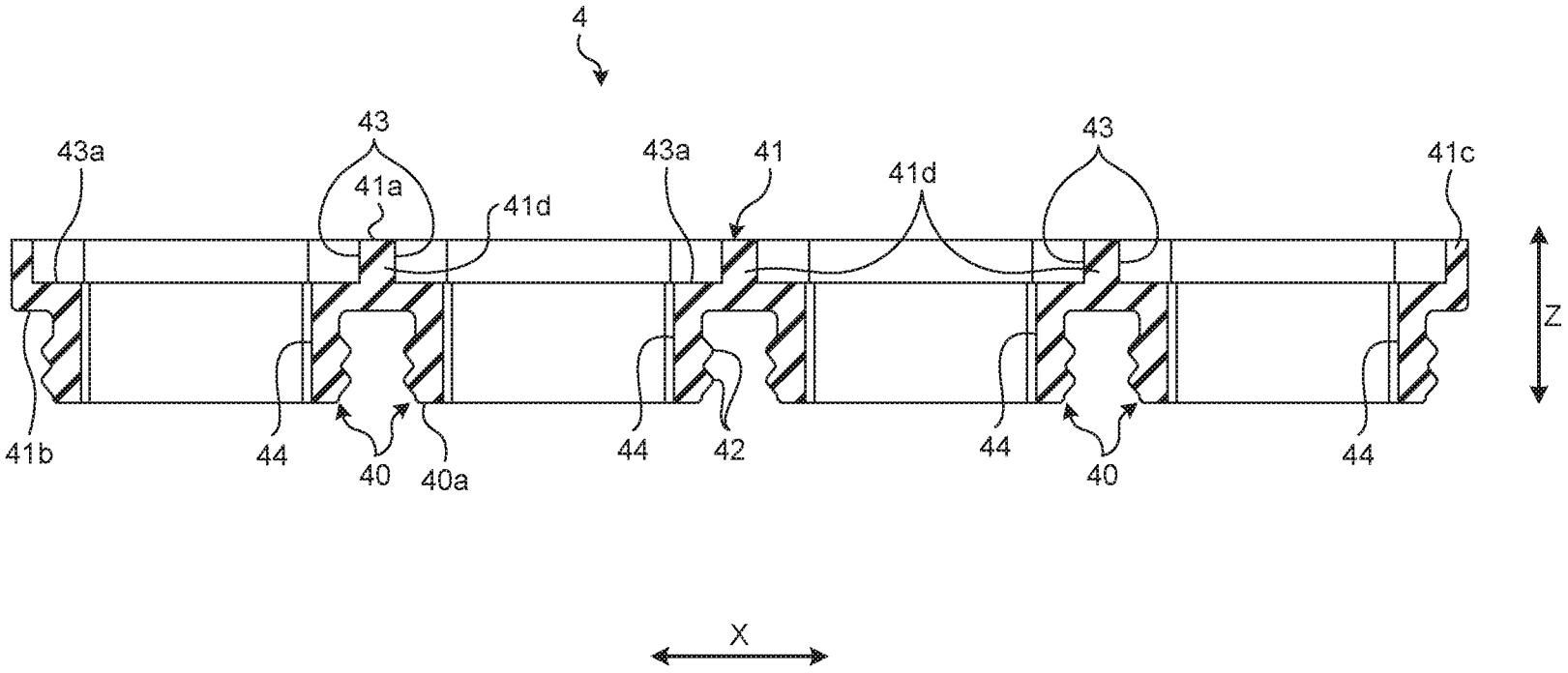
FIG. 10 is a sectional view of the sealing member according to the embodiment.

With reference to FIG. 1 to FIG. 26, the embodiment will be described. The present embodiment relates to a connector. FIG. 1 is a sectional view of a connector, a first device, and a second device according to an embodiment, FIG. 2 is an exploded perspective view of the connector according to the embodiment, FIG. 3 is a plan view of a housing according to the embodiment, FIG. 4 is a front view of the housing according to the embodiment, FIG. 5 is a side view of the housing according to the embodiment, FIG. 6 is a sectional view of the housing according to the embodiment, FIG. 7 is another sectional view of the housing according to the embodiment, FIG. 8 is a front view of a sealing member according to the embodiment, FIG. 9 is a side view of the sealing member according to the embodiment, and FIG. 10 is a sectional view of the sealing member according to the embodiment.

Figure 11:
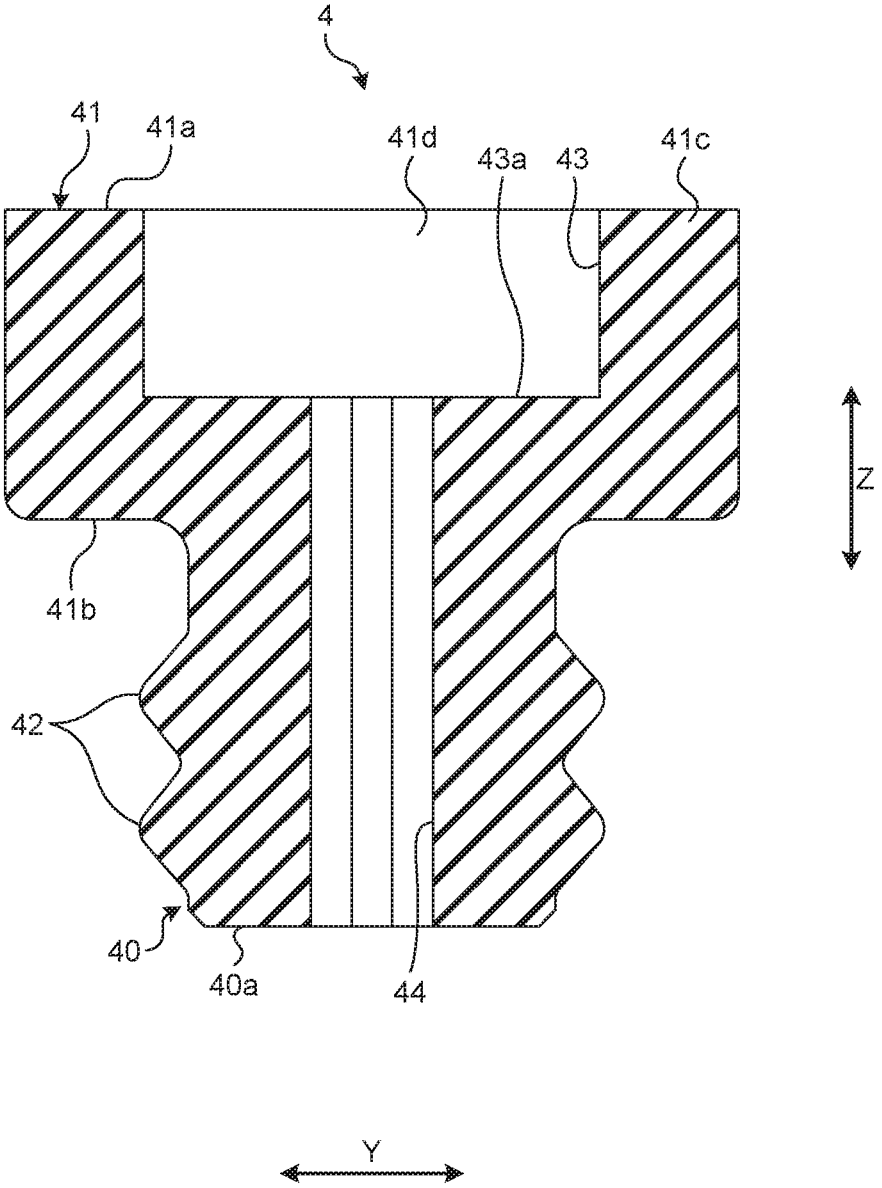
FIG. 11 is another sectional view of the sealing member according to the embodiment.
Figure 12:
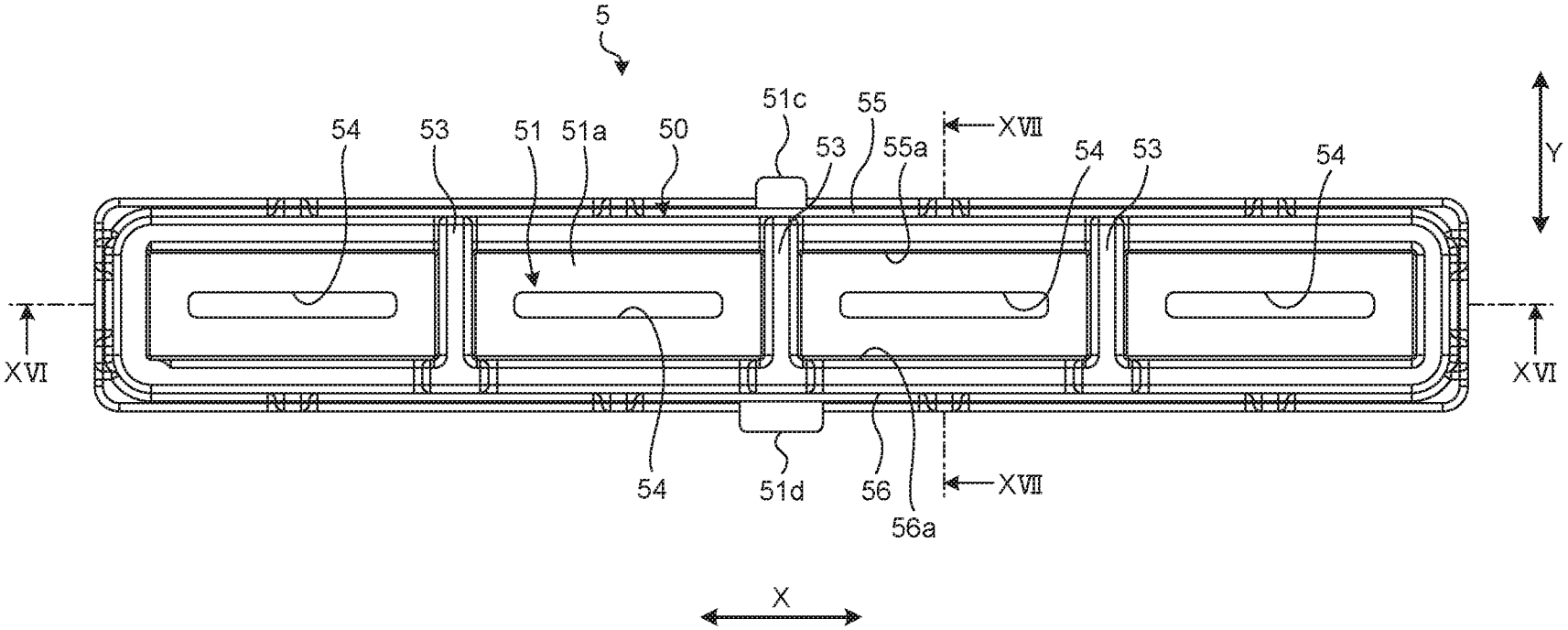
FIG. 12 is a plan view of a support member according to the embodiment.
Figure 13:
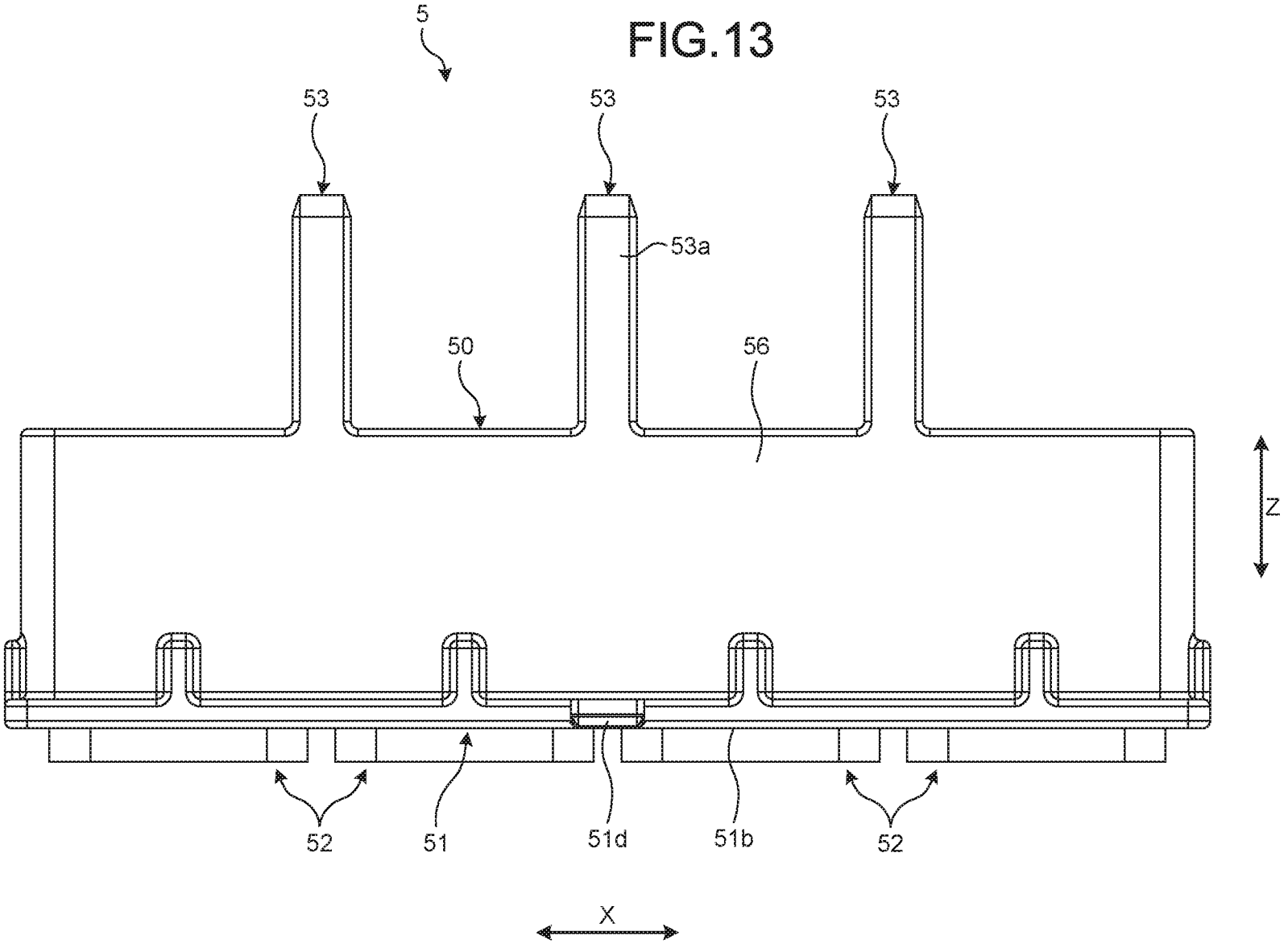
FIG. 13 is a front view of the support member according to the embodiment.
Figure 14:
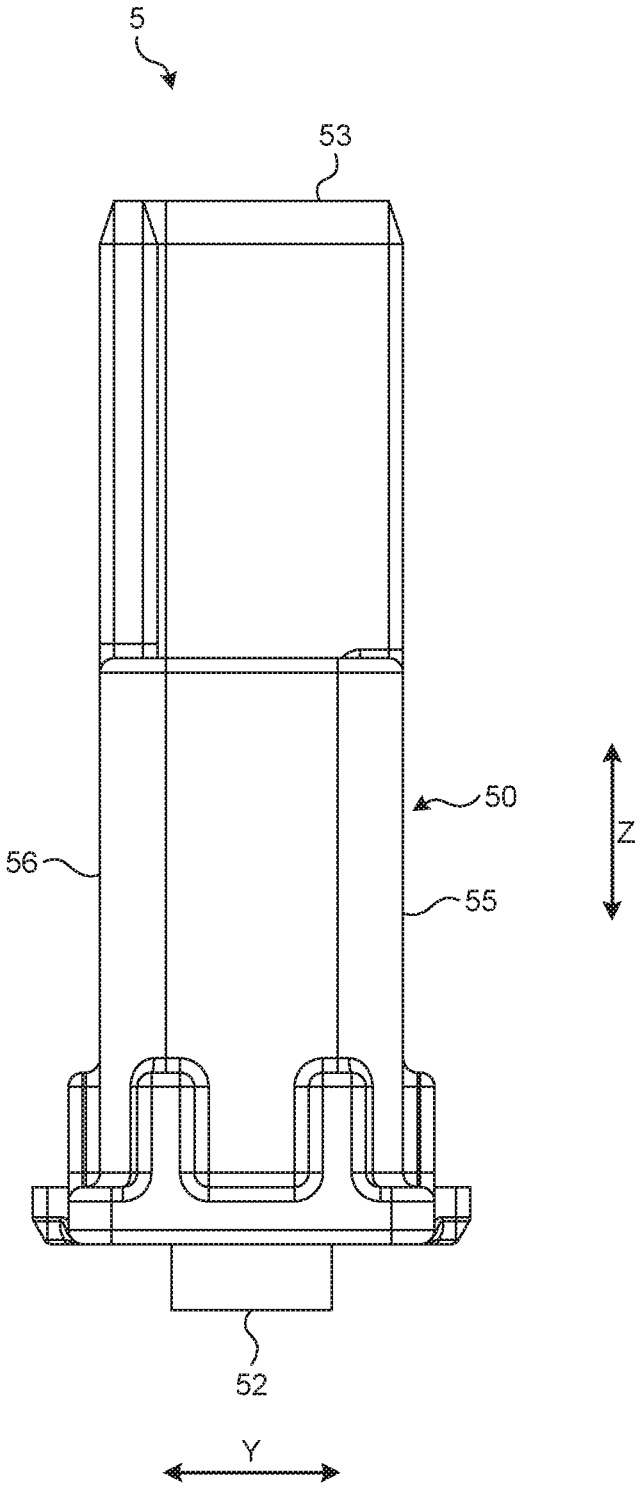
FIG. 14 is a side view of the support member according to the embodiment.
Figure 15:
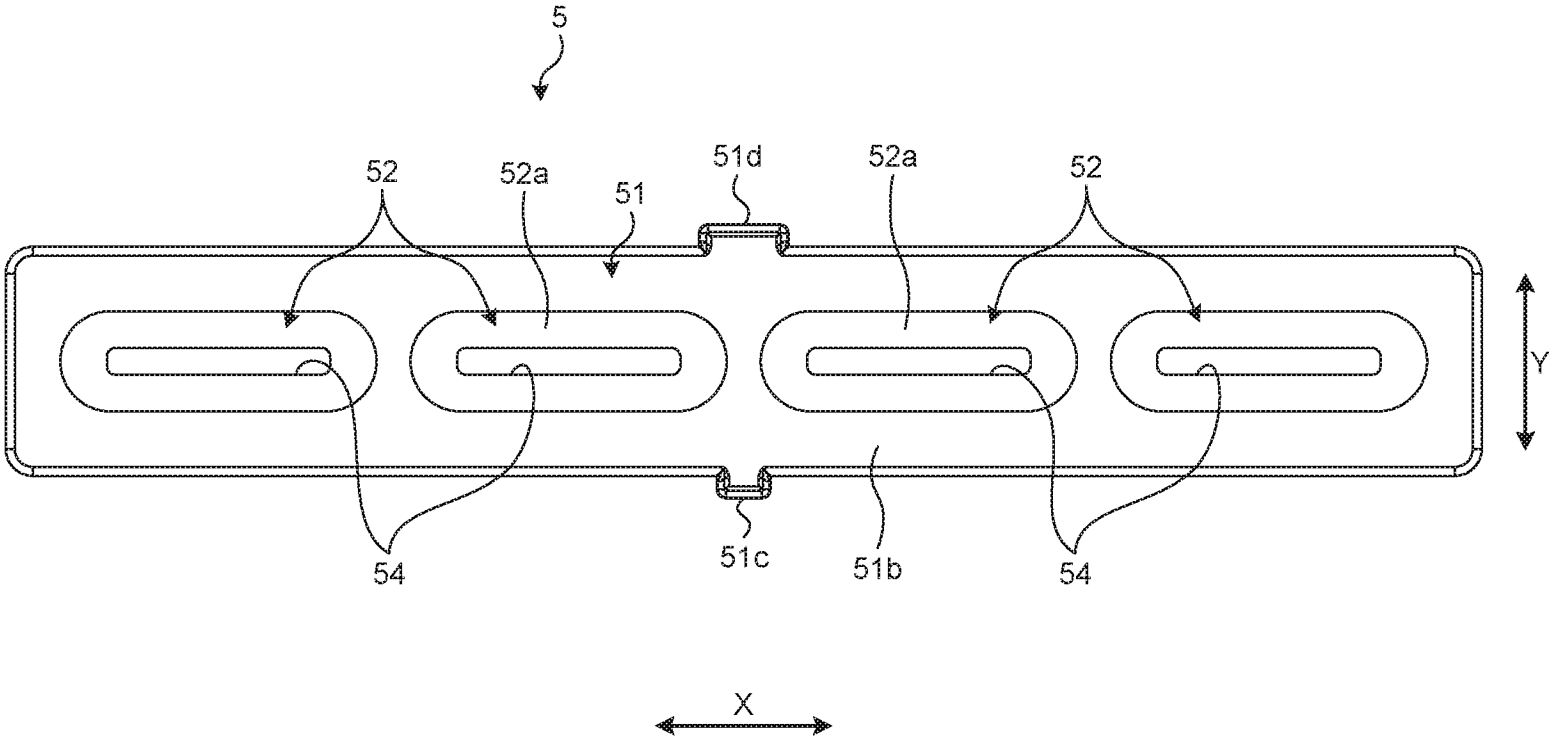
FIG. 15 is a bottom view of the support member according to the embodiment.
Figure 16:
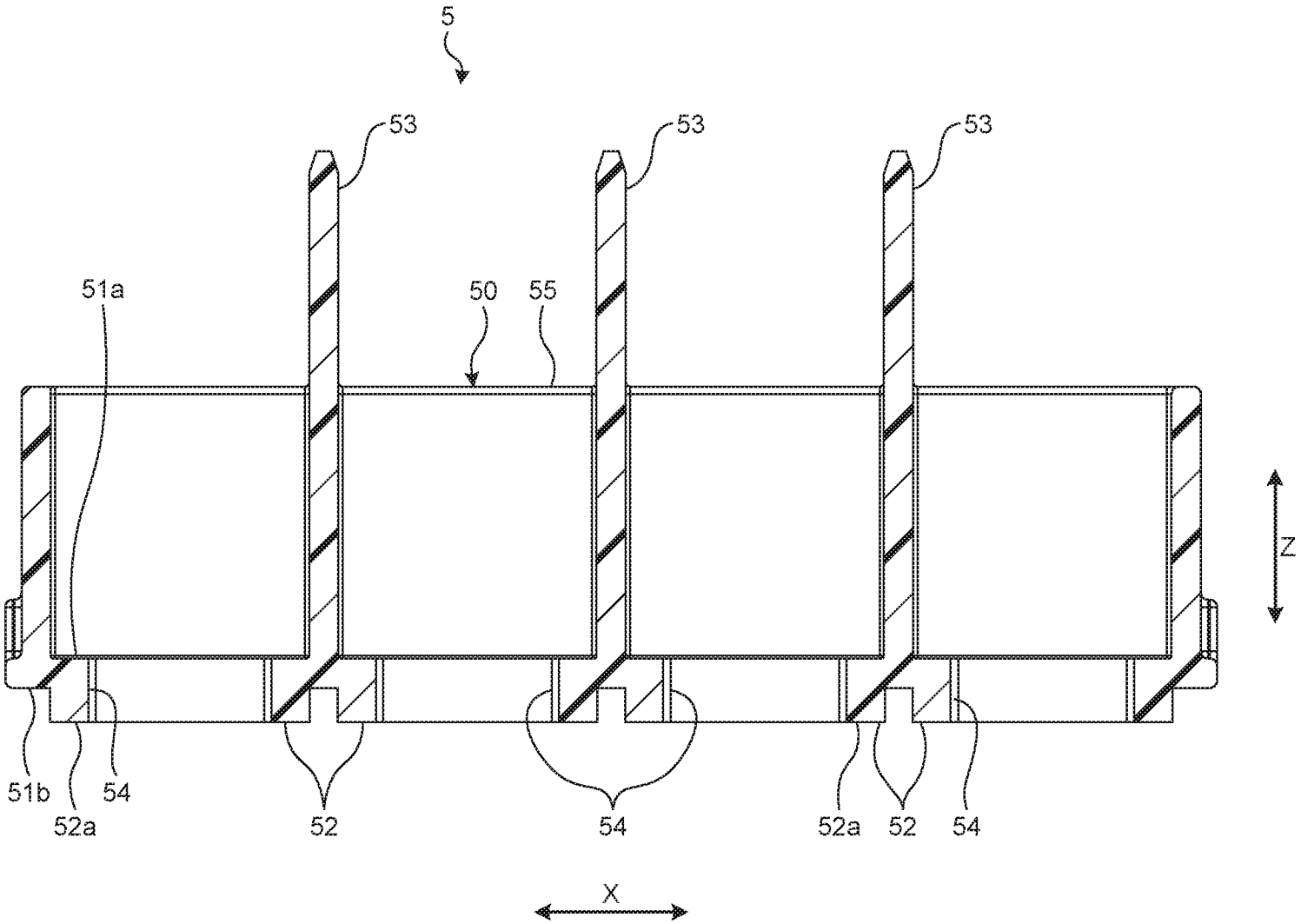
FIG. 16 is a sectional view of the support member according to the embodiment.
Figure 17:
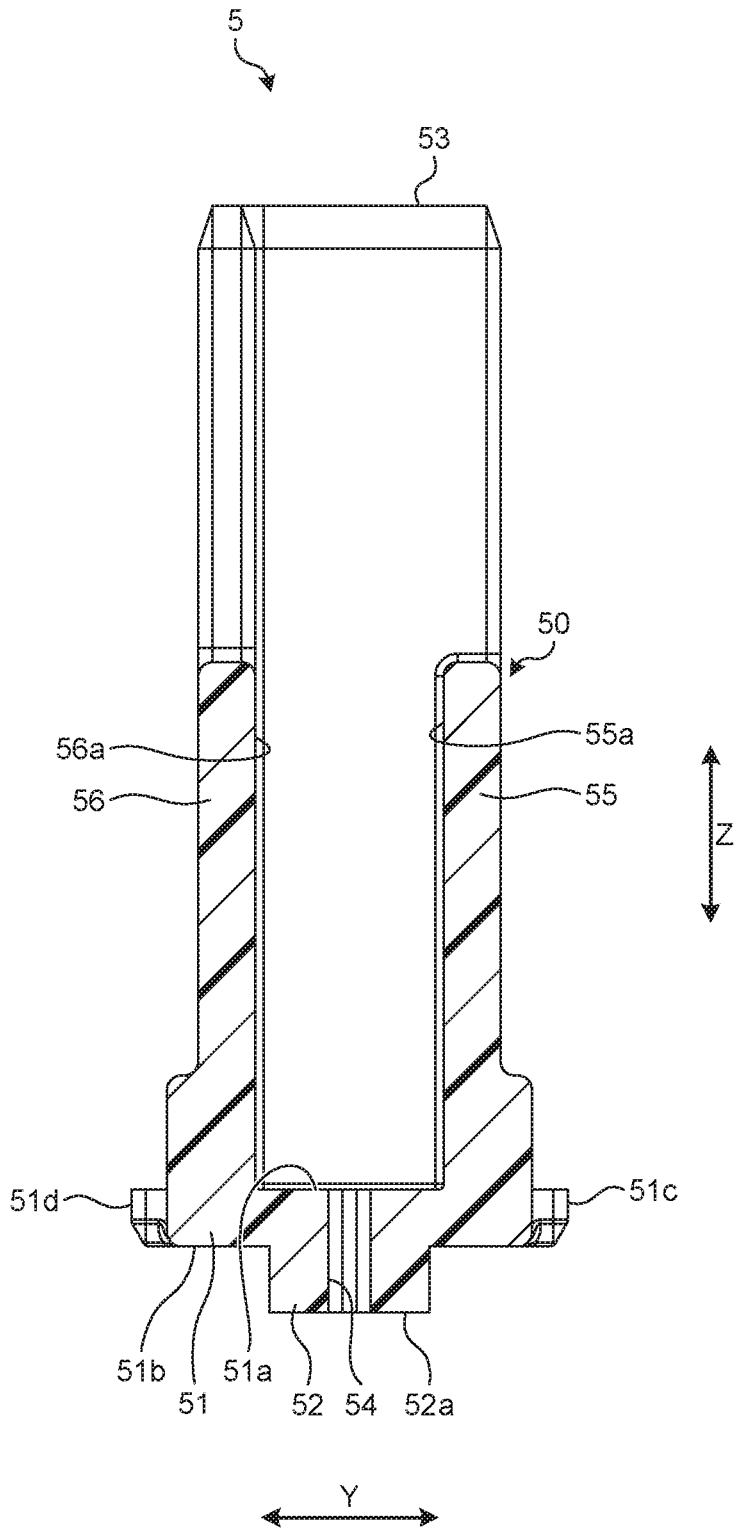
FIG. 17 is another sectional view of the support member according to the embodiment.
Figure 18:
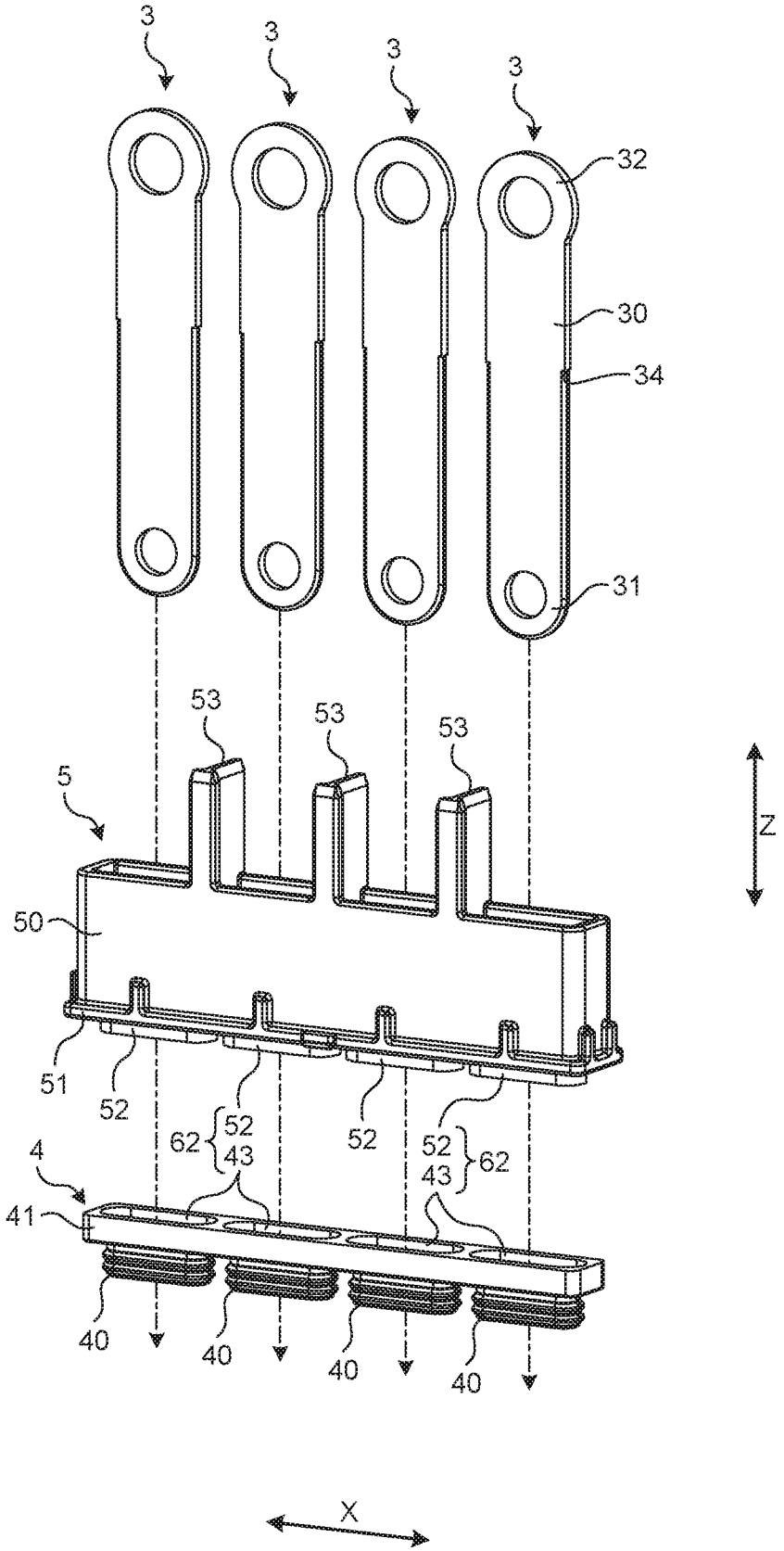
FIG. 18 is a perspective view for explaining assembly of a conductor unit.
Figure 19:
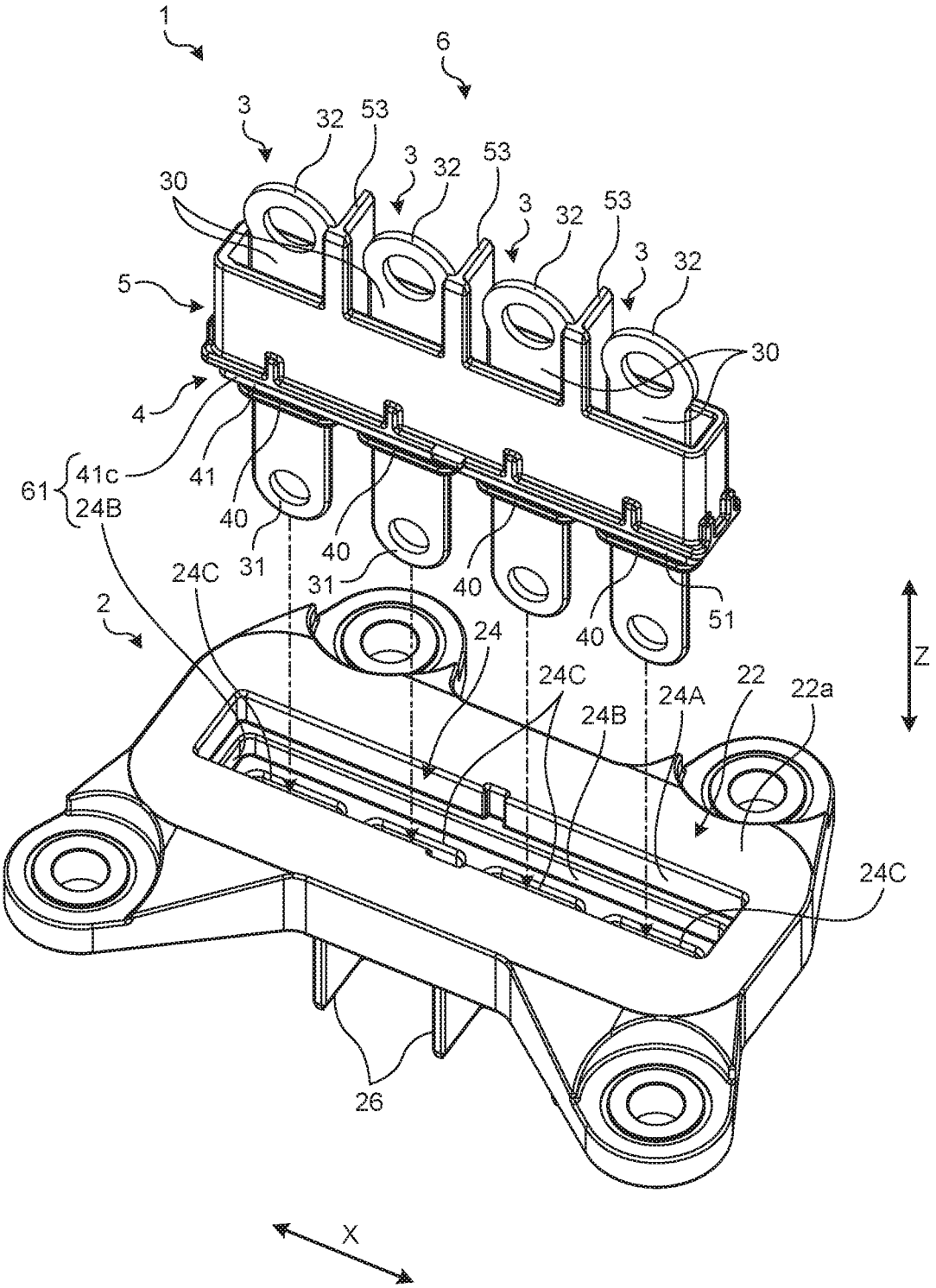
FIG. 19 is a perspective view for explaining assembly of the conductor unit with respect to the housing.
Figure 20:
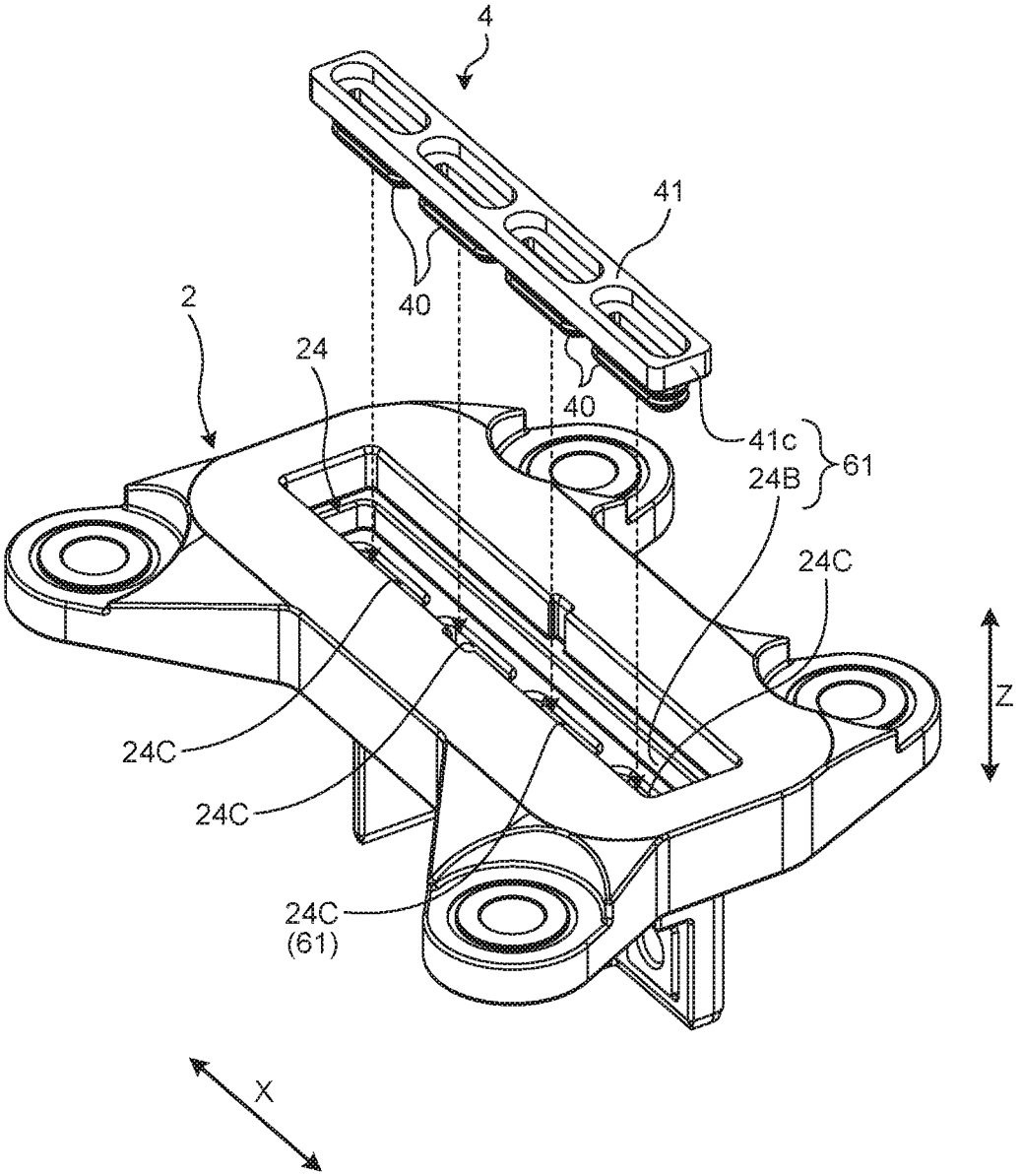
FIG. 20 is a perspective view for explaining assembly of the sealing member with respect to the housing.
Figure 21:
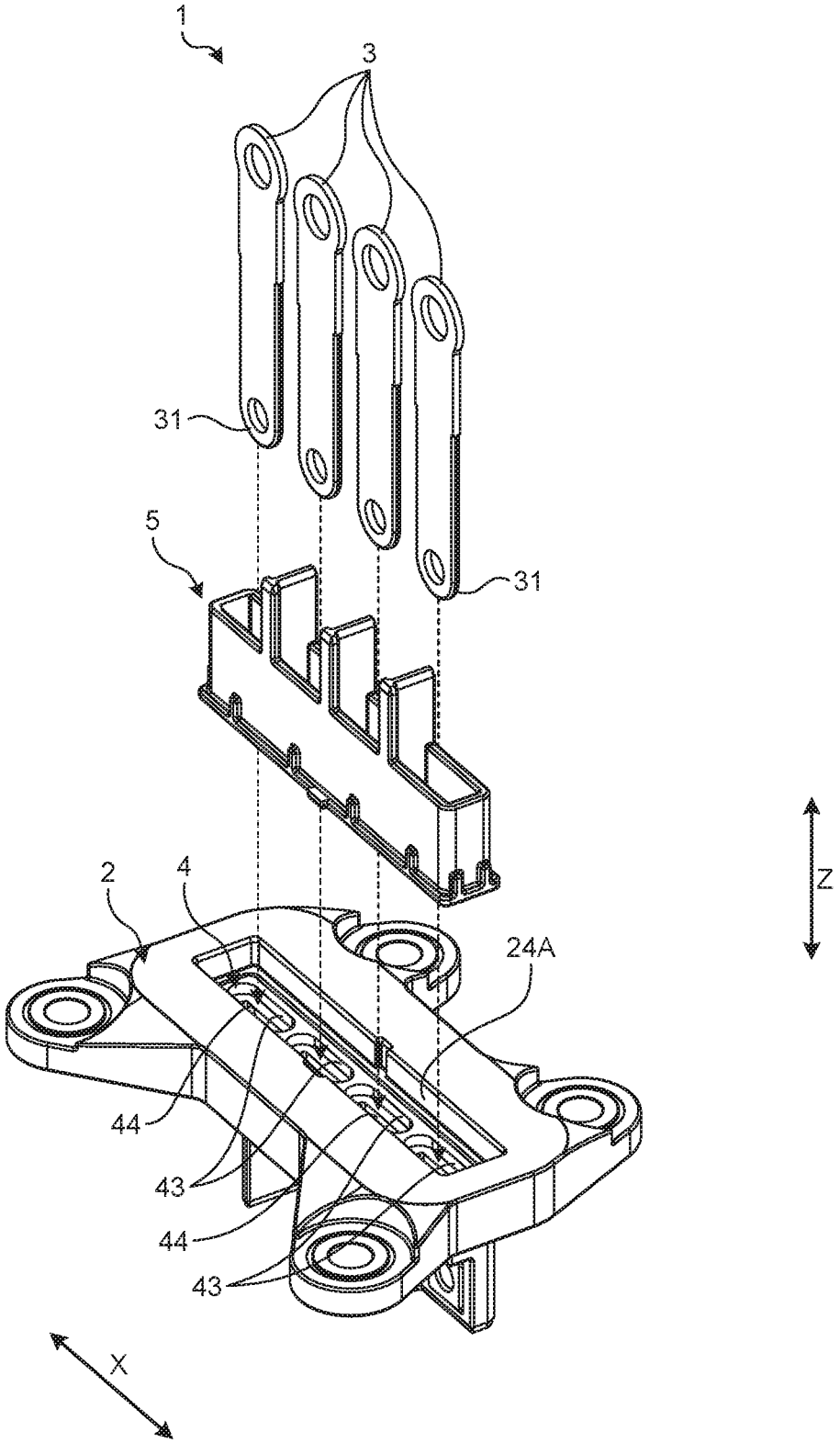
FIG. 21 is a perspective view for explaining assembly of the support member and conductors with respect to the housing and the sealing member.

FIG. 11 is another sectional view of the sealing member according to the embodiment, FIG. 12 is a plan view of a support member according to the embodiment, FIG. 13 is a front view of the support member according to the embodiment, FIG. 14 is a side view of the support member according to the embodiment, FIG. 15 is a bottom view of the support member according to the embodiment, FIG. 16 is a sectional view of the support member according to the embodiment, FIG. 17 is another sectional view of the support member according to the embodiment, FIG. 18 is a perspective view for explaining assembly of a conductor unit, FIG. 19 is a perspective view for explaining assembly of the conductor unit with respect to the housing, FIG. 20 is a perspective view for explaining assembly of the sealing member with respect to the housing, and FIG. 21 is a perspective view for explaining assembly of the support member and conductors with respect to the housing and the sealing member.

Figure 22:
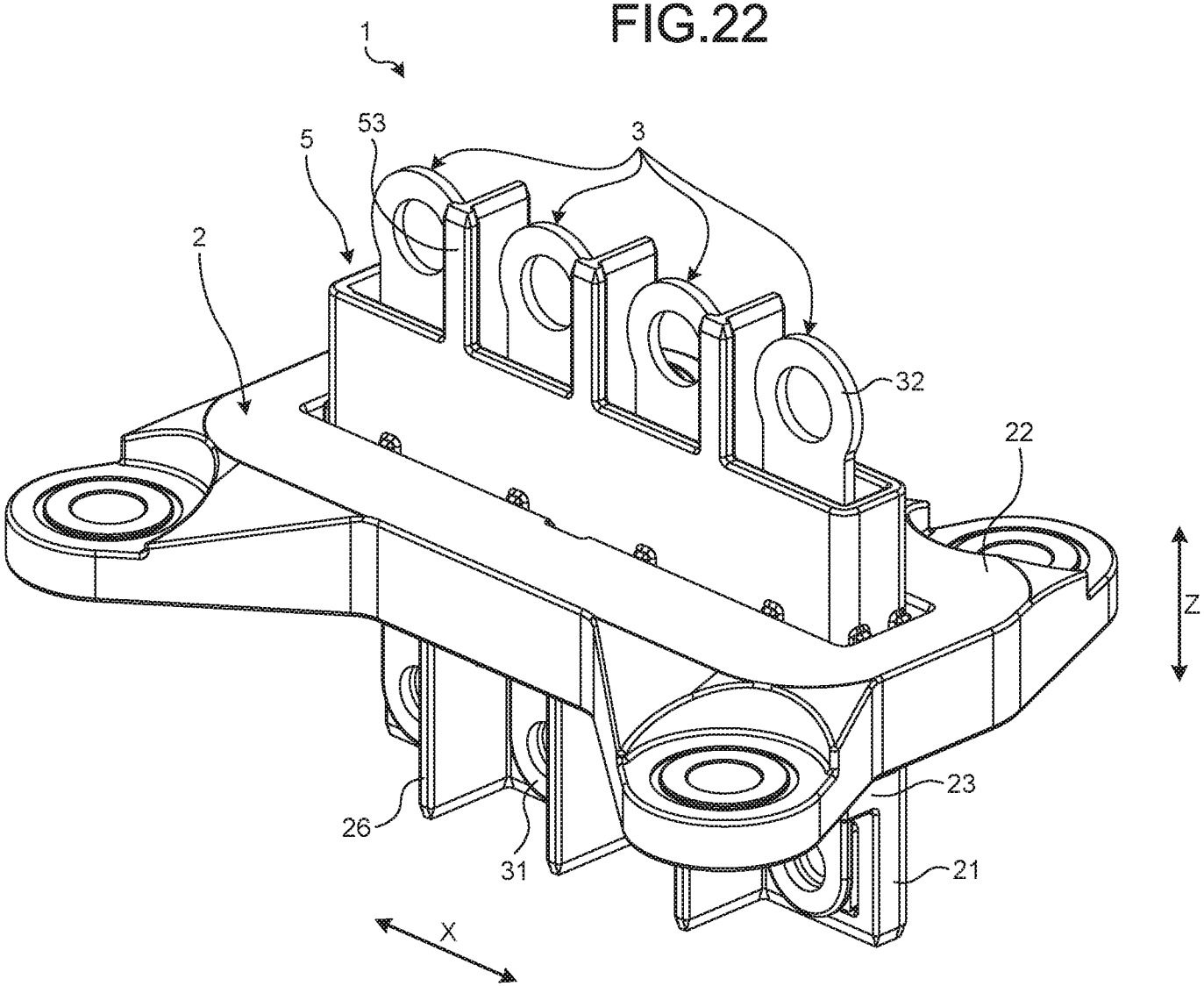
FIG. 22 is a perspective view of the connector according to the embodiment.
Figure 23:
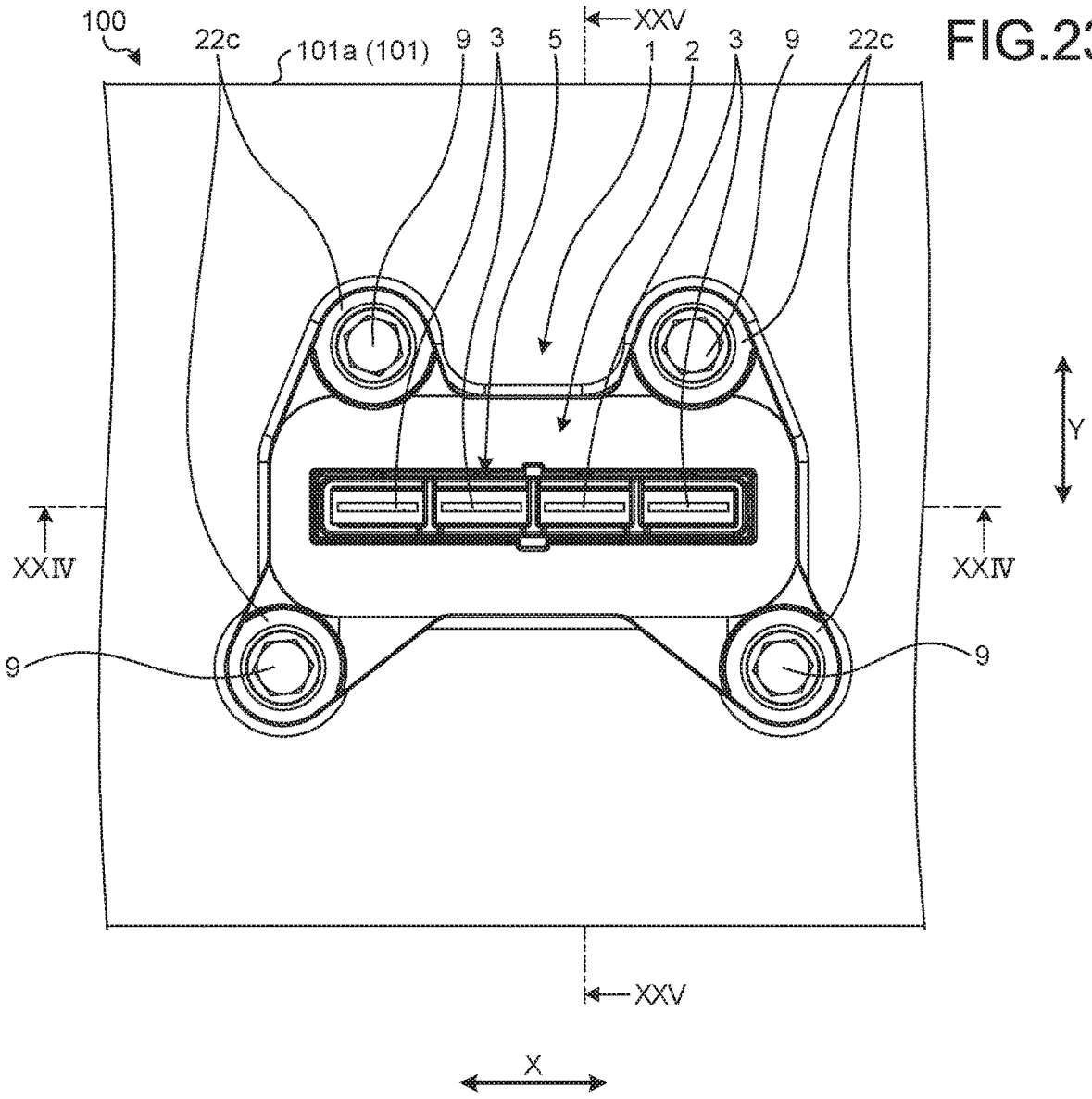
FIG. 23 is a plan view illustrating the connector attached to the first device.
Figure 24:
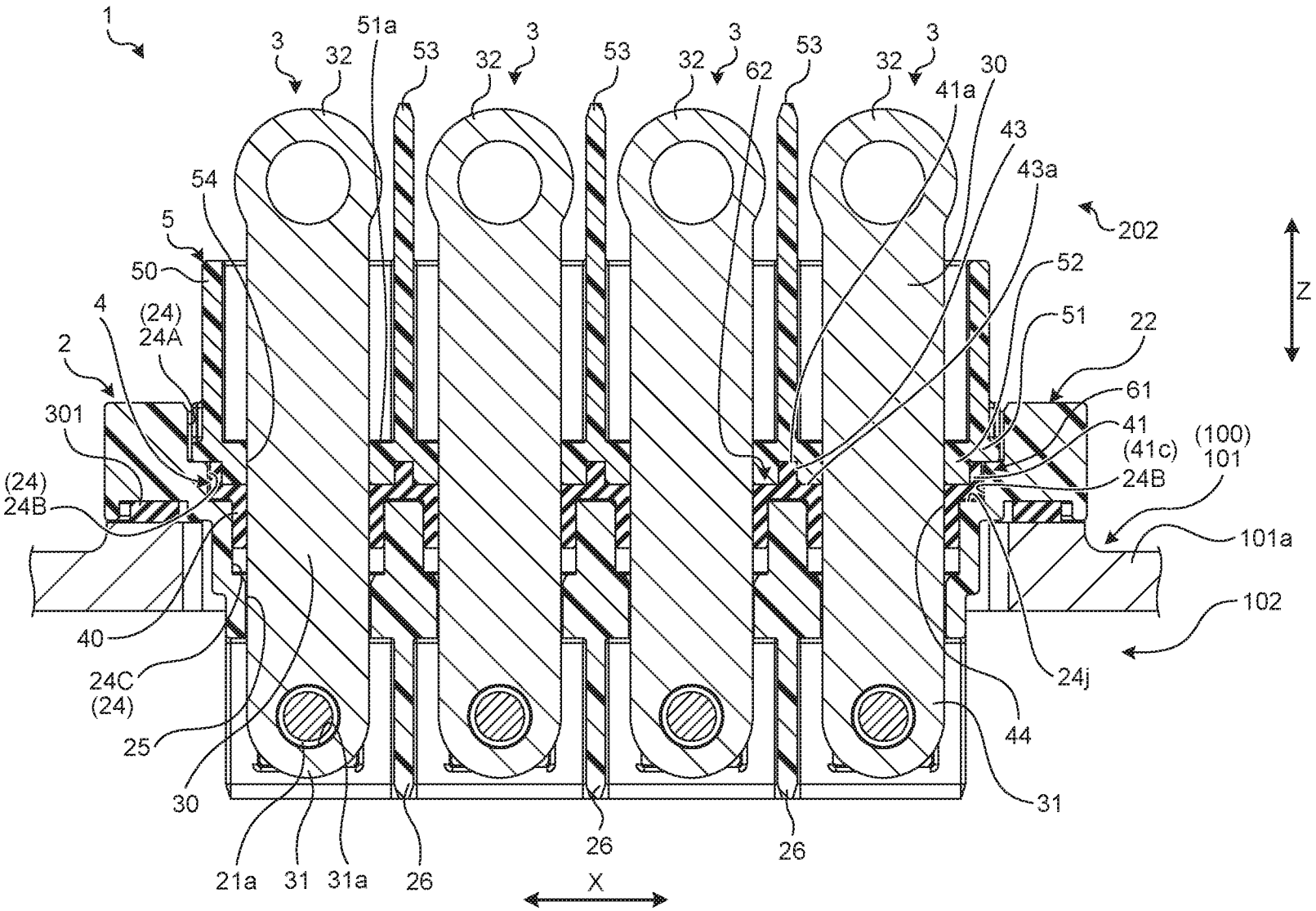
FIG. 24 is a sectional view of the connector according to the embodiment.
Figure 25:
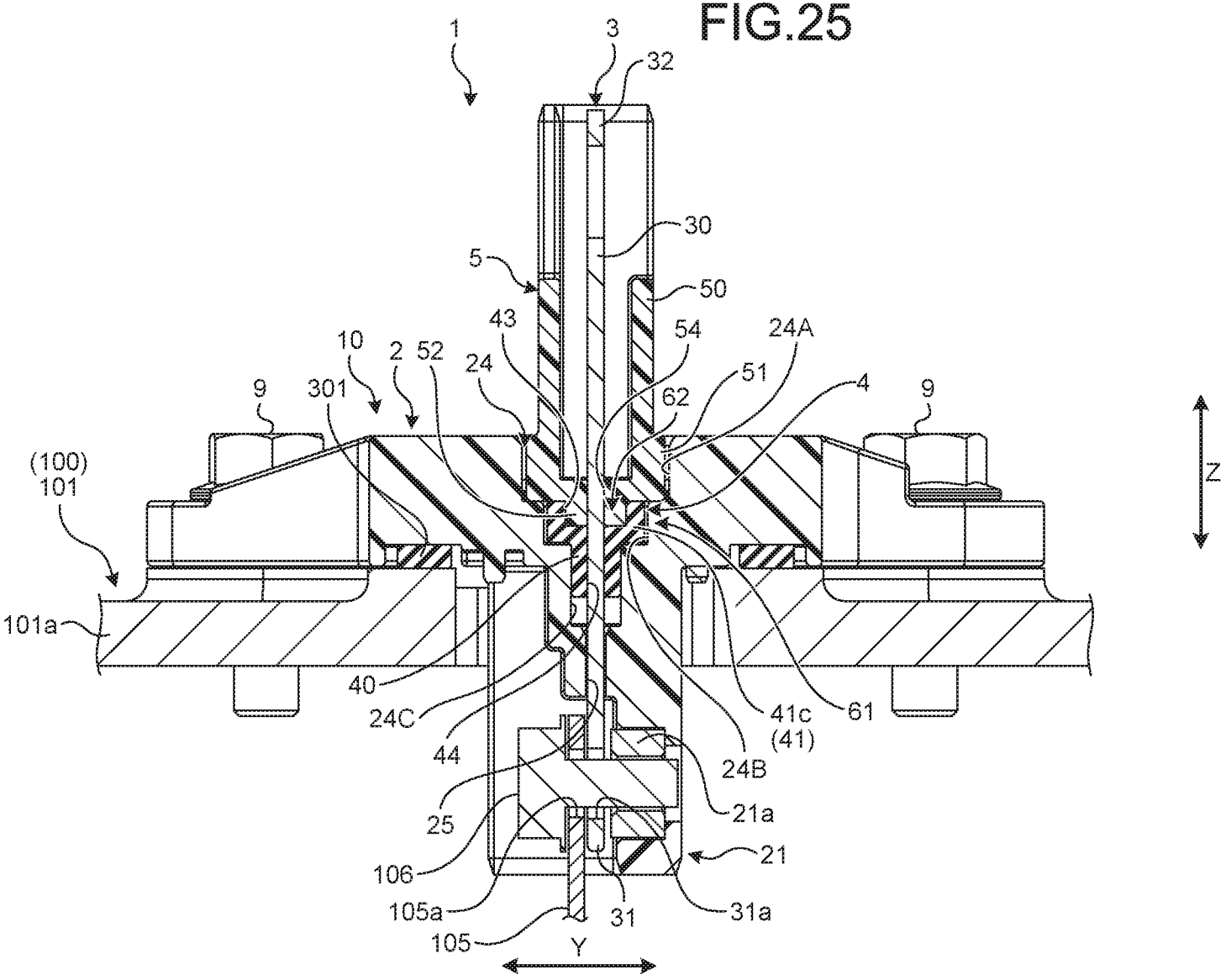
FIG. 25 is another sectional view of the connector according to the embodiment.
Figure 26:
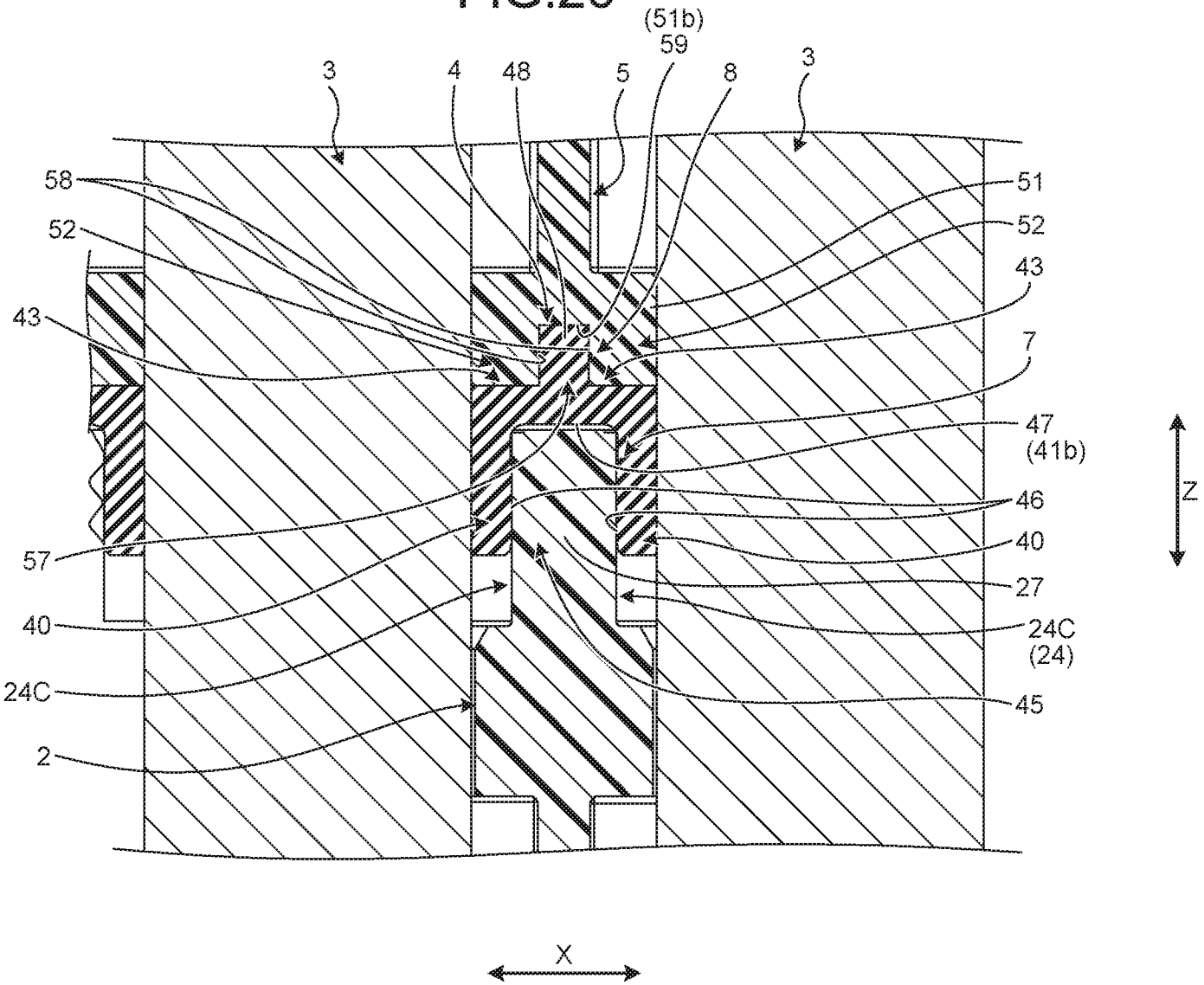
FIG. 26 is an enlarged sectional view of the connector according to the embodiment.

FIG. 22 is a perspective view of the connector according to the embodiment, FIG. 23 is a plan view illustrating the connector attached to the first device, FIG. 24 is a sectional view of the connector according to the embodiment, FIG. 25 is another sectional view of the connector according to the embodiment, and FIG. 26 is an enlarged sectional view of the connector according to the embodiment.

Figure 3:
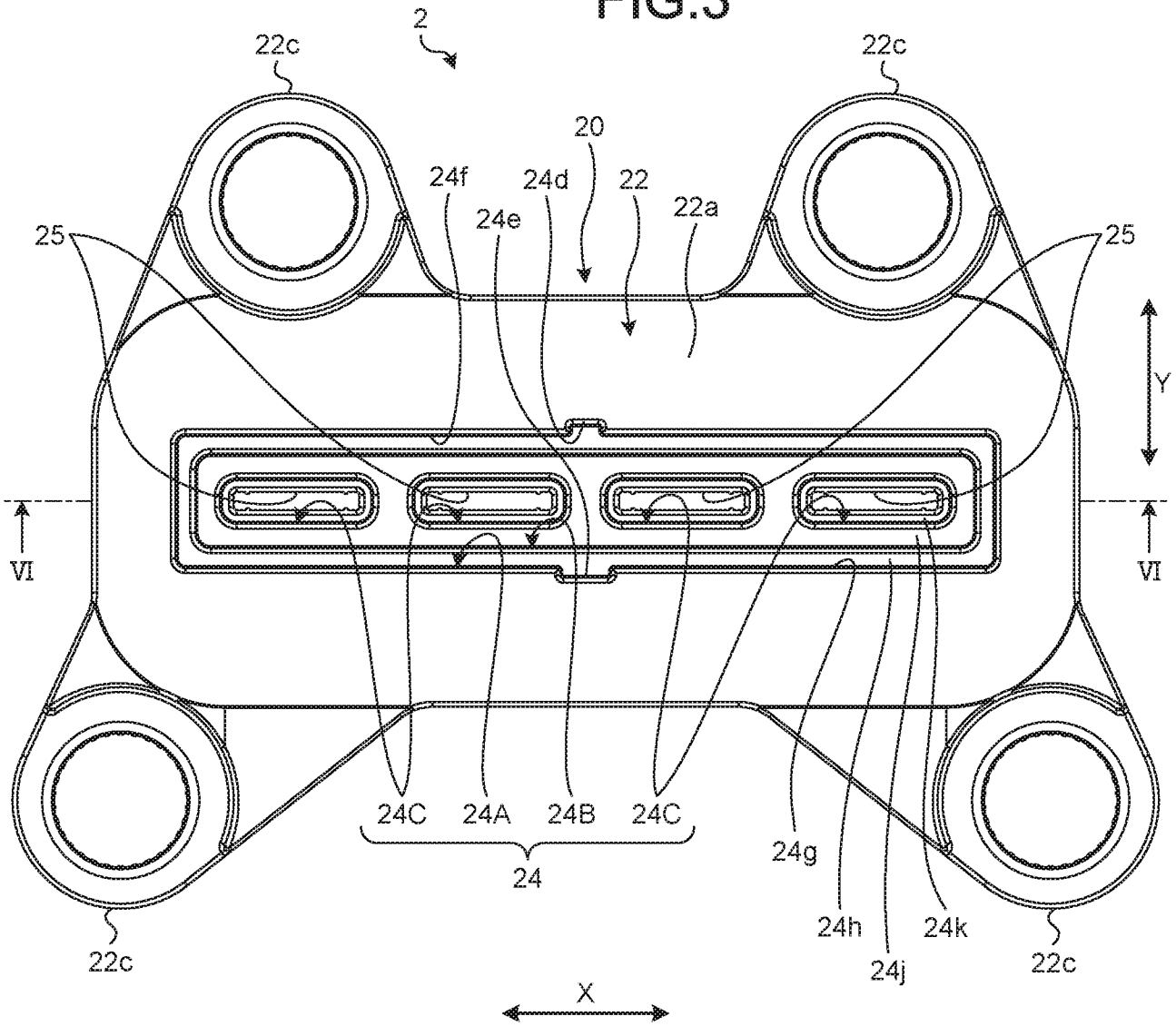
FIG. 3 is a plan view of a housing according to the embodiment.
Figure 6:
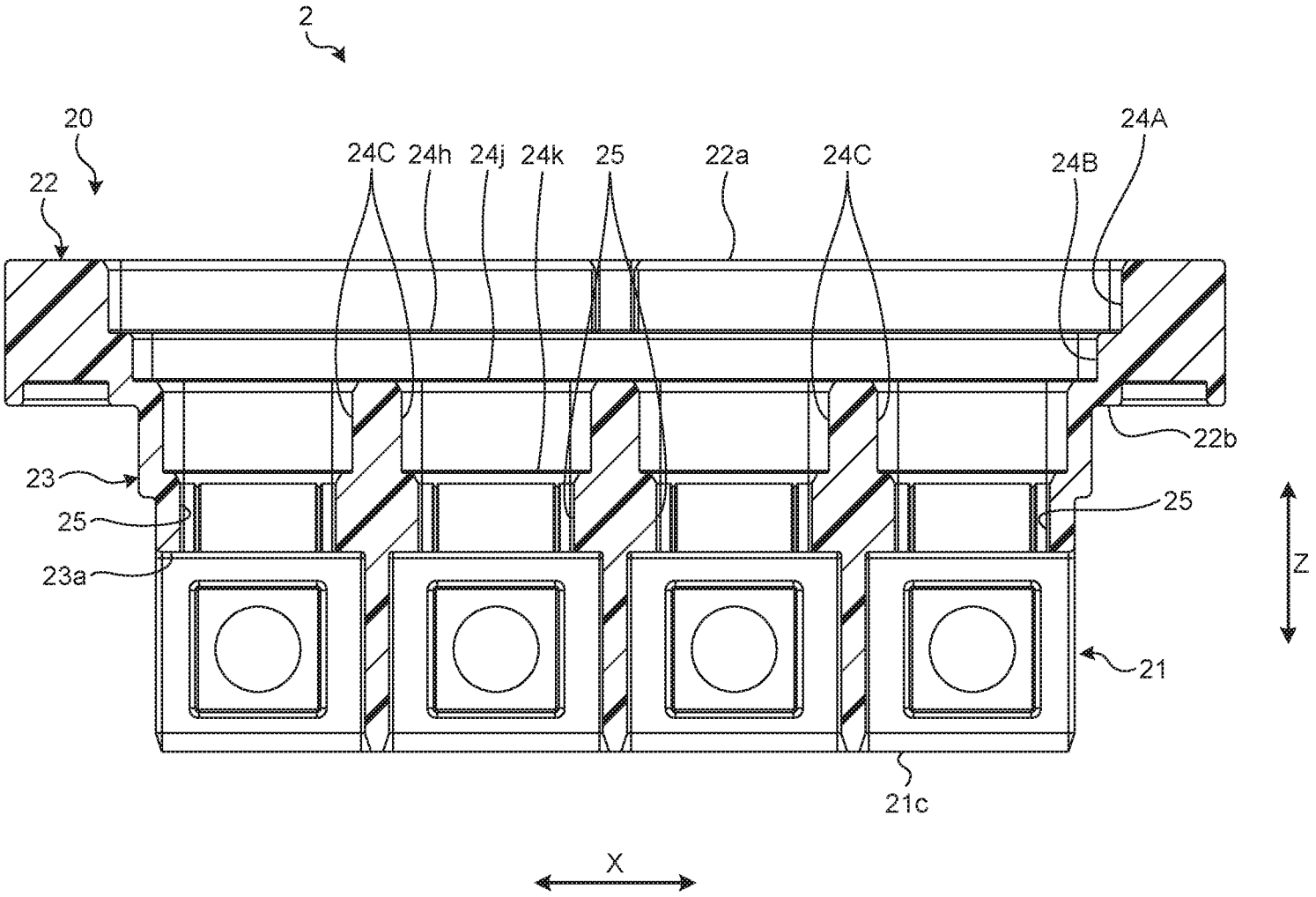
FIG. 6 is a sectional view of the housing according to the embodiment.

FIG. 6 illustrates a section taken along line VI-VI of FIG. 3. FIG. 7 illustrates a section taken along line VII-VII of FIG. 4. FIG. 10 illustrates a section taken along line X-X of FIG. 9. FIG. 11 illustrates a section taken along line XI-XI of FIG. 8. FIG. 16 illustrates a section taken along line XVI-XVI of FIG. 12. FIG. 17 illustrates a section taken along line XVII-XVII of FIG. 12. FIG. 24 illustrates a section taken along line XXIV-XXIV of FIG. 23. FIG. 25 illustrates a section taken along line XXV-XXV of FIG. 23.

As illustrated in FIG. 1 and FIG. 2, a connector 1 according to the embodiment has a housing 2, a plurality of conductors 3, a sealing member 4, and a support member 5. The connector 1 electrically connects a first device 100 and a second device 200. In the present embodiment, the first device 100 is a motor and the second device 200 is an inverter. The first device 100 and the second device 200 are mounted on a vehicle such as an automobile, for example. A motor body 103 of the first device 100 and an inverter body 203 of the second device 200 are electrically connected via the conductors 3.

The second device 200 is interposed between a battery mounted on the vehicle and the first device 100. The second device 200 has a conversion function between a direct current and an alternating current and a transformation function of increasing and decreasing a voltage. The supply of electric power from the battery to the first device 100 is controlled by the second device 200. Furthermore, electric power generated by regeneration in the first device 100 is stored in the battery via the second device 200.

The first device 100 has a casing 101 and the motor body 103. The motor body 103 is a main component of the first device 100 and includes a rotor and a stator. The motor body 103 is disposed in an internal space 102 of the casing 101. In the internal space 102 of the casing 101, a first liquid 104 is stored. The first liquid 104 is a liquid having a lubricating function and a cooling function for the motor body 103, and is, for example, oil. An upper wall part 101*a* of the casing 101 has an opening 101*b*. The opening 101*b* penetrates the wall part 101*a* and allows the internal space 102 of the casing 101 and an external space of the casing 101 to communicate with each other.

The second device 200 has a casing 201 and the inverter body 203. The inverter body 203 is a main component of the second device 200 and includes a switching circuit. The inverter body 203 is disposed in an internal space 202 of the casing 201. A pipe 204 is provided in the internal space 202 of the casing 201. A second liquid 205 for cooling is supplied to the inverter body 203 via the pipe 204. The second liquid 205 is, for example, cooling water. A lower wall part 201*a* of the casing 201 has an opening 201*b*.

The casing 101 and the casing 201 are fixed to each other with the opening 101*b* and the opening 201*b* facing each other. A gasket 300 is interposed between the wall part 101*a* of the casing 101 and the wall part 201*a* of the casing 201.

The connector 1 is fixed to the casing 101 of the first device 100 at a communication part 10 through which the opening 101*b* of the first device 100 and the opening 201*b* of the second device 200 communicate with each other. The communication part 10 is a part where the opening 101*b* of the first device 100 and the opening 201*b* of the second device 200 face each other. In the present embodiment, the opening 201*b* of the second device 200 is larger than the opening 101*b* of the first device 100. Accordingly, the wall part 101*a* of the first device 100 is exposed toward the internal space 202 of the second device 200.

As illustrated in FIG. 1 and FIG. 2, each of the conductors 3 of the present embodiment is a bus bar. The number of the conductors 3 included in the connector 1 of the present embodiment is four. However, the number of the conductors 3 is not limited to four. The conductor 3 is made of a conductive metal, for example, copper, aluminum, and the like. The conductor 3 is formed, for example, by being punched out from a metal plate as a base material. The conductor 3 has a body 30, a first terminal part 31, and a second terminal part 32. The body 30 has a rectangular plate shape.

The first terminal part 31 is connected to one end of the body 30 in a longitudinal direction. The first terminal part 31 is electrically connected to a terminal included in the first device 100. The first terminal part 31 has a circular shape, for example. The outer diameter of the first terminal part 31 is equal to the width of the body 30. The first terminal part 31 has a through hole 31*a* into which a fastening member is inserted. The second terminal part 32 is connected to the other end of the body 30 in the longitudinal direction. The second terminal part 32 is electrically connected to a terminal included in the second device 200. The second terminal part 32 has a circular shape, for example. The second terminal part 32 has a through hole 32*a* into which a fastening member is inserted. The outer diameter of the second terminal part 32 is larger than that of the first terminal part 31. Furthermore, the outer diameter of the second terminal part 32 is larger than the width of the body 30.

A chamfered part 33 is formed on a part of the body 30 and the first terminal part 31. The chamfered part 33 is formed on both edges of the body 30 and the first terminal part 31 in a width direction. The chamfered part 33 has a sectional arc shape, for example. The body 30 has a stopper 34. The stopper 34 is a stepped part at the boundary between a part of the body 30 where the chamfered part 33 is provided and a part where the chamfered part 33 is not provided. The stopper 34 abuts the support member 5 and locks the support member 5.

Each of the conductors 3 is inserted into the housing 2 with the first terminal part 31 as a head. In the present embodiment, the longitudinal direction of the conductor 3 is referred to as a "height direction Z". The height direction Z is a direction connecting the first terminal part 31 and the second terminal part 32, and is an axial direction of the conductor 3. Furthermore, a direction in which the conductors 3 are arranged is referred to as a "first direction X". The first direction X is orthogonal to the height direction Z. A direction orthogonal to both the first direction X and the height direction Z is referred to as a "second direction Y". The second direction Y is a plate thickness direction of the conductor 3.

As illustrated in FIG. 2, the housing 2 has a body 20 and a wall part 21. The body 20 and the wall part 21 are integrally molded of an insulating synthetic resin, for example. The material of the housing 2 is resistant to the first liquid 104. The material of the housing 2 is, for example, an oil-resistant synthetic resin. The body 20 is a part fixed to the wall part 101*a* of the first device 100. The body 20 has a base 22 formed in a plate shape and a protruding part 23 protruding toward the height direction Z from the base 22. The wall part 21 protrudes toward the height direction Z from a tip end of the protruding part 23.

As illustrated in FIG. 3, the base 22 has a substantially planar rectangular shape. The longitudinal direction of the base 22 is the first direction X. The base 22 is provided at the four corners thereof with fixed parts 22*c* each having through holes. The fixed parts 22*c* are fixed to the wall part 101*a* of the first device 100 by, for example, bolts 9 (see FIG. 23). The base 22 has a first surface 22*a* and a second surface 22*b*. The second surface 22*b* is a surface on which the protruding part 23 is provided. The first surface 22*a* is a surface opposite to the second surface 22*b*. The base 22 is fixed with the first surface 22*a* facing the second device 200 and with the second surface 22*b* facing the wall part 101*a*. The first surface 22*a* faces upward when the first device 100 and the second device 200 are installed in a vehicle, for example.

As illustrated in FIG. 4 and FIG. 5, the protruding part 23 protrudes toward the height direction Z from the second surface 22*b* of the base 22. The protruding part 23 has a substantially rectangular parallelepiped shape. The protruding part 23 in a section orthogonal to the height direction Z has a substantially sectional rectangular shape. In the sectional shape of the protruding part 23, the longitudinal direction is the first direction X.

As illustrated in FIG. 2 and FIG. 3, the body 20 has a recess 24 formed in multiple stages. The recess 24 is opened to the first surface 22*a* of the base 22 and is recessed toward the wall part 21 along the height direction Z. The recess 24 has a first recess 24A, a second recess 24B, and third recesses 24C. The first recess 24A is fitted to the support member 5 and supports the support member 5 from below. The second recess 24B and the third recesses 24C are fitted to the sealing member 4 and supports the sealing member 4 from below.

As illustrated in FIG. 3, the first recess 24A has a substantially planar rectangular shape. The longitudinal direction of the first recess 24A is the first direction X. The first recess 24A has a first wall surface 24*f* and a second wall surface 24*g* facing each other in the second direction Y. The first wall surface 24*f* and the second wall surface 24*g* are surfaces along the first direction X and the height direction Z.

The first recess 24A has a first groove 24*d* and a second groove 24*e*. The first groove 24*d* and the second groove 24*e* restrict the direction when the support member 5 is attached to the housing 2, and prevent erroneous assembly. The first groove 24*d* and the second groove 24*e* extend along the height direction Z. The first groove 24*d* is provided on the first wall surface 24*f*. The second groove 24*e* is provided on the second wall surface 24*g*. The first groove 24*d* and the second groove 24*e* face each other in the second direction Y. The groove width of the first groove 24*d* is smaller than that of the second groove 24*e*.

The second recess 24B is recessed along the height direction Z from a bottom surface 24*h* of the first recess 24A toward the wall part 21 side. The second recess 24B has a substantially planar rectangular shape. The longitudinal direction of the second recess 24B is the first direction X. The third recesses 24C are recessed along the height direction Z from a bottom surface 24*j* of the second recess 24B toward the wall part 21 side. The recess 24 of the present embodiment has a plurality of third recesses 24C. The number of the third recesses 24C is set to four in accordance with the number of the conductors 3. The four third recesses 24C are arranged in a row along the first direction X. The four third recesses 24C are disposed at equal intervals, for example. Each of the third recesses 24C has a substantially planar rectangular shape. The longitudinal direction of the third recess 24C is the first direction X.

As illustrated in FIG. 3, the body 20 has a plurality of first through holes 25. The conductors 3 are press-fitted into the first through holes 25 and held by the first through holes 25. Each of the first through holes 25 has a sectional shape corresponding to that of the conductor 3, and has a rectangular shape, for example. The longitudinal direction in the sectional shape of the first through hole 25 is the first direction X. The number of the first through holes 25 included in the body 20 is four in accordance with the number of the conductors 3 to be inserted. The first through holes 25 are disposed at equal intervals along the first direction X.

The first through holes 25 penetrate the body 20 along the height direction Z. One end of the first through hole 25 is opened to a bottom surface 24*k* of the third recess 24C. The other end of the first through hole 25 is opened to a tip end surface 23*a* of the protruding part 23. One first through hole 25 is disposed for one third recess 24C. Note that the recess 24 and the first through holes 25 may be combined and regarded as a continuous through hole. In such a case, the through hole is understood as a multi-step through hole whose sectional area gradually decreases from the first surface 22*a* of the base 22 to the tip end surface 23*a* of the protruding part 23.

The wall part 21 is a rectangular flat plate-shaped component part and protrudes toward the height direction Z from the tip end surface 23*a* of the protruding part 23. As illustrated in FIG. 4, FIG. 7 and the like, the wall part 21 holds nuts 21*a*. Four nuts 21*a* are fixed to the wall part 21 of the present embodiment in correspondence with the four conductors 3. The nuts 21*a* are integrally formed with the wall part 21 by molding, for example. A screw hole 21*b* of each of the nuts 21*a* extends along the second direction Y. The first terminal part 31 of the conductor 3 and a terminal 105 of the first device 100 are co-fastened to the nut 21*a* by a fastening member 106 (see FIG. 25).

The housing 2 has a plurality of insulating walls 26. Each of the insulating walls 26 is a wall that divides between the adjacent conductors 3. The housing 2 of the present embodiment has three insulating walls 26 in correspondence with the four conductors 3. The insulating walls 26 protrude toward the second direction Y from the side surface of the protruding part 23 and the wall part 21. The insulating walls 26 extend along the height direction Z from the second surface 22*b* of the base 22 to a tip end surface 21*c* of the wall part 21.

As illustrated in FIG. 8 to FIG. 11, the sealing member 4 has a plurality of sealing parts 40 and a connecting part 41. The sealing member 4 is an insulating member having a mat seal shape in which a plurality of O-rings are connected in series. The sealing member 4 of the present embodiment has four sealing parts 40 in correspondence with the four conductors 3. The four sealing parts 40 are disposed in a row along the first direction X. The four sealing parts 40 are disposed at equal intervals, for example. The sealing parts 40 and the connecting part 41 are integrally molded of a resin such as rubber. The material of the sealing member 4 is a material having resistance to the first liquid 104, and is, for example, oil-resistant silicon rubber and the like.

The sealing parts 40 seal between the conductors 3 and the housing 2. The shape of each of the sealing parts 40 is annular, for example, tubular. The sectional shape of the sealing part 40 of the present embodiment is elliptical or rectangular. The longitudinal direction of the sealing part 40 is the first direction X. The sealing part 40 is a shaft seal whose inner peripheral surface is in close contact with the conductor 3 and whose outer peripheral surface is in close contact with the housing 2. The sealing part 40 is provided on the outer peripheral surface thereof with an annular lip 42.

As illustrated in FIG. 8 and the like, the connecting part 41 has a flat plate shape. The connecting part 41 has a first surface 41*a* and a second surface 41*b*. The first surface 41*a* is a surface facing the second device 200. The first surface 41*a* faces upward when the first device 100 and the second device 200 are installed in a vehicle, for example. The second surface 41*b* is a surface opposite to the first surface 41*a*. The second surface 41*b* faces downward when the first device 100 and the second device 200 are installed in a vehicle, for example. The sealing parts 40 protrude toward the height direction Z from the second surface 41*b*.

As illustrated in FIG. 2 and FIG. 10, the connecting part 41 has a frame part 41*c* and division parts 41*d*. The frame part 41*c* is an annular part that surrounds the conductors 3. The shape of the frame part 41*c* in the plan view is a rectangle. The division parts 41*d* are parts that divide an area surrounded by the frame part 41*c*. The division parts 41*d* extend along the second direction Y. The connecting part 41 of the present embodiment has three division parts 41*d* disposed at equal intervals along the first direction X.

The connecting part 41 has recesses 43. Each of the recesses 43 is composed of the frame part 41*c* and the division part 41*d*. Protrusions 52 of the support member 5 are inserted in the recesses 43. The connecting part 41 of the present embodiment has four recesses 43 in correspondence with the four conductors 3. The four recesses 43 are arranged in a row along the first direction X. The four recesses 43 are disposed at equal intervals, for example. The recesses 43 are recessed along the height direction Z from the first surface 41*a* toward the second surface 41*b*. That is, the recesses 43 are opened toward the height direction Z on the first surface 41*a*. Each of the recesses 43 has a substantially elliptical shape in the plan view. The longitudinal direction of the recess 43 is the first direction X.

The sealing member 4 has a plurality of through holes 44 into which the conductors 3 are inserted. Each of the through holes 44 has a substantially sectional rectangular shape. The longitudinal direction in the sectional shape of the through hole 44 is the first direction X. The sealing member 4 has four through holes 44 in correspondence with the four conductors 3. The four through holes 44 are disposed at equal intervals, for example. The through holes 44 penetrate the connecting part 41 and the sealing parts 40 along the height direction Z. One end of the through hole 44 is opened to a bottom surface 43*a* of the recess 43. The other end of the through hole 44 is opened to a tip end surface 40*a* of the sealing part 40. One through hole 44 is disposed for one sealing part 40. Note that the recess 43 and the through holes 44 may be combined and regarded as one continuous through hole. In such a case, the through hole is understood as a through hole that penetrates from the first surface 41*a* of the connecting part 41 to the tip end surface 40*a* of the sealing part 40 and has a smaller sectional area on the tip end surface 40*a* side than the bottom surface 43*a*.

As illustrated in FIG. 12 to FIG. 17, the support member 5 has a tubular part 50, a bottom wall part 51, the protrusions 52, and insulating walls 53. The support member 5 of the present embodiment is an integral mat seal stopper in which a plurality of O-rings are connected in series. The tubular part 50, the bottom wall part 51, the protrusions 52, and the insulating walls 53 are integrally molded of an insulating synthetic resin, for example. The material of the support member 5 is resistance to the second liquid 205. Note that the material of the support member 5 may be a material not resistance to the first liquid 104 or a material having low resistance to the first liquid 104, compared with the material of the housing 2.

The tubular part 50 has a rectangular tubular shape. The outer shape of the tubular part 50 in the plan view is a rectangle. The longitudinal direction of the tubular part 50 is the first direction X. The tubular part 50 has a first wall part 55 and a second wall part 56 facing each other in the second direction Y.

The bottom wall part 51 is a wall part that closes one opening of the tubular part 50. An inner surface 51*a* of the bottom wall part 51 is a surface facing the second device 200. The inner surface 51*a* is a surface facing upward when the first device 100 and the second device 200 are installed in a vehicle, for example. The bottom wall part 51 is provided on the side surface thereof with a first lib 51*c* and a second lib 51*d* protruding toward the second direction Y. The first lib 51*c* is disposed on an edge of the bottom wall part 51 on the first wall part 55 side. The second lib 51*d* is disposed on an edge of the bottom wall part 51 on the second wall part 56 side. The first lib 51*c* is guided by the first groove 24*d* of the housing 2. The second lib 51*d* is guided by the second groove 24*e* of the housing 2. In the first direction X, the width of the first lib 51*c* is smaller than that of the second lib 51*d*.

As illustrated in FIG. 13 to FIG. 17, the protrusions 52 protrude along the height direction Z from an outer surface 51*b* of the bottom wall part 51. The protrusions 52 serve as O-ring stoppers that support the sealing parts 40. The support member 5 of the present embodiment has four protrusions 52 in correspondence with the four conductors 3. The four protrusions 52 are arranged in a row along the first direction X. The four protrusions 52 are disposed at equal intervals, for example. As illustrated in FIG. 15, in the plan view, the protrusion 52 has an elliptical shape. The shape of the protrusion 52 corresponds to the shape of the recess 43 of the sealing member 4 and the shape of the sealing part 40.

The support member 5 has a plurality of second through holes 54 into which the conductors 3 are inserted. Each of the second through holes 54 has a substantially sectional rectangular shape. The longitudinal direction in the sectional shape of the second through hole 54 is the first direction X. The support member 5 has four second through holes 54 in correspondence with the four conductors 3. The four second through holes 54 are arranged along the first direction X. The four second through holes 54 are disposed at equal intervals, for example. The second through holes 54 penetrate the bottom wall part 51 and the protrusions 52 along the height direction Z. One end of the second through hole 54 is opened to the inner surface 51*a* of the bottom wall part 51. The other end of the second through hole 54 is opened to a tip end surface 52*a* of the protrusion 52. One second through hole 54 is disposed for one protrusion 52.

The insulating walls 53 are walls that divide between the adjacent conductors 3. The insulating walls 53 are connected to an inner surface 55*a* of the first wall part 55, an inner surface 56*a* of the second wall part 56, and the inner surface 51*a* of the bottom wall part 51, and divide the internal space of the tubular part 50. Furthermore, each of the insulating walls 53 has a protruding part 53*a* protruding from the tubular part 50 along the height direction Z.

The connector 1 configured as described above has a first fitting structure 61 and a second fitting structure 62 as will be described below. The first fitting structure 61 is a structure in which the housing 2 and the sealing member 4 are fitted to each other along the axial direction of the conductor 3. The first fitting structure 61 is a structure in which the other of the housing 2 and the sealing member 4 is fitted into the recess provided in one of the housing 2 and the sealing member 4. As illustrated in FIG. 19, the first fitting structure 61 of the present embodiment has the frame part 41*c* of the sealing member 4 and the second recess 24B of the housing 2.

The second fitting structure 62 is a structure in which the sealing member 4 and the support member 5 are fitted to each other along the axial direction of the conductor 3. The second fitting structure 62 is a structure in which the other of the sealing member 4 and the support member 5 is fitted into the recess provided in one of the sealing member 4 and the support member 5. As illustrated in FIG. 18, the second fitting structure 62 of the present embodiment has the recesses 43 provided in the connecting part 41 of the sealing member 4 and the protrusions 52 provided in the support member 5 and fitted into the recesses 43. The connector 1 of the present embodiment has the first fitting structure 61 and the second fitting structure 62, and thus has a high degree of freedom of assembly work.

The connector 1 of the present embodiment is assembled as follows, for example. First, as illustrated in FIG. 18, the sealing member 4, the support member 5, and the conductors 3 are assembled together. Specifically, the protrusions 52 of the support member 5 are inserted into the recesses 43 of the sealing member 4. That is, the second fitting structure 62 is brought into a fitted state. With this, the connecting part 41 of the sealing member 4 is attached to the support member 5. Furthermore, the conductors 3 are inserted into the second through holes 54 of the support member 5 and the through holes 44 of the sealing member 4. The conductors 3 are inserted into the four pairs of through holes 54 and 44, respectively. With this, as illustrated in FIG. 19, a conductor unit 6 in which the conductors 3, one support member 5, and one sealing member 4 are assembled is formed.

In the conductor unit 6, each of the insulating walls 53 divides between the adjacent two conductors 3. More specifically, the insulating walls 53 protrude from the tip end of the second terminal part 32 along the height direction Z. That is, the insulating walls 53 conceal the entire second terminal part 32 from the entire adjacent second terminal part 32.

As illustrated in FIG. 19, the conductor unit 6 is attached to the housing 2. The sealing member 4 and the support member 5 serve as a guide for guiding the conductors 3 to the first through holes 25 of the housing 2. That is, the sealing member 4 and the support member 5 can allow the multipolar conductors 3 to be inserted into the first through holes 25 at the same time. As illustrated in FIG. 19, in the conductor unit 6, the first terminal parts 31 are first inserted into the recesses 24 of the housing 2. The sealing parts 40 of the sealing member 4 are inserted into the third recesses 24C of the housing 2. The connecting part 41 of the sealing member 4 is inserted into the second recess 24B. With this, the frame part 41*c* of the connecting part 41 is fitted into the second recess 24B, and the second fitting structure 62 is brought into a fitted state. The bottom wall part 51 of the support member 5 is inserted into the first recess 24A of the housing 2. The conductors 3 are press-fitted into the first through holes 25 of the housing 2, so that the conductor unit 6 is held by the housing 2.

The connector 1 may be assembled as illustrated in FIG. 20 and FIG. 21. First, as illustrated in FIG. 20, the sealing member 4 is attached to the housing 2. The sealing parts 40 of the sealing member 4 are inserted into the corresponding third recesses 24C of the housing 2. The frame part 41*c* of the sealing member 4 is inserted into the second recess 24B of the housing 2 and fitted into the second recess 24B. That is, the first fitting structure 61 is brought into a fitted state. The frame part 41*c* is received in the second recess 24B and is supported by the bottom surface 24*j* of the second recess 24B. The sealing member 4 is held by the recess 24 of the housing 2.

Next, as illustrated in FIG. 21, the support member 5 and the conductors 3 are assembled to the housing 2 and the sealing member 4. For example, the conductors 3 are assembled to the support member 5. Thereafter, the support member 5 and the conductors 3 are assembled together to the housing 2 and the sealing member 4. The protrusions 52 of the support member 5 are fitted into the recesses 43 of the sealing member 4. That is, the second fitting structure 62 is brought into a fitted state. Furthermore, the bottom wall part 51 of the support member 5 is fitted into the first recess 24A of the housing 2. The first terminal parts 31 of the conductors 3 are inserted into the through holes 44 of the sealing member 4 and the first through holes 25 of the housing 2. Note that the support member 5 may be assembled to the housing 2 and the sealing member 4 and then the conductors 3 may be assembled. The housing 2, the sealing member 4, the support member 5, and the conductors 3 are assembled together to form the connector 1 illustrated in FIG. 22.

FIG. 23 illustrates the connector 1 attached to the casing 101 of the first device 100. The housing 2 of the connector 1 is fixed to the upper wall part 101*a* by the bolts 9. Between the housing 2 and the wall part 101*a*, for example, a face seal 301 is interposed.

As illustrated in FIG. 24 and FIG. 25, the sealing part 40 is interposed between the conductor 3 and the third recess 24C. The inner peripheral surface of the sealing part 40 is in close contact with the body 30 of the conductor 3, and the outer peripheral surface of the sealing part 40 is in close contact with the inner wall surface of the third recess 24C. The sealing part 40 closes a gap between the conductor 3 and the housing 2, and restricts the flow of liquid between the internal space 102 of the first device 100 and the internal space 202 of the second device 200. That is, the sealing part 40 restricts the first liquid 104 of the first device 100 from leaking to a space on the support member 5 side of the sealing part 40.

In the connector 1 of the present embodiment, the conductors 3 are press-fitted into the first through holes 25 of the housing 2, and held by the first through holes 25. The conductors 3 are inserted into the first through holes 25, up to a position where the stoppers 34 (see FIG. 2) abut on the bottom wall part 51 of the support member 5. The stoppers 34 of the conductors 3 support the support member 5 while pressing the support member 5 toward the sealing member 4.

The protrusions 52 of the support member 5 are received in the recesses 43 of the sealing member 4. The protrusions 52 come into contact with the bottom surface 43*a* of the recess 43. Furthermore, the bottom wall part 51 of the support member 5 comes into contact with the first surface 41*a* of the connecting part 41. In other words, the support member 5 interposes the sealing member 4 between the support member 5 and the housing 2 to support the sealing member 4 from the second device 200 side. The protrusions 52 of the support member 5 support the sealing parts 40 of the sealing member 4 from the second device 200 side. Accordingly, the support member 5 can support the sealing parts 40 against the pressure of the internal space 102 of the first device 100 and suppress deformation of the sealing parts 40. Furthermore, the sealing parts 40 are connected by the connecting part 41, so that the deformation of the sealing part 40 is suppressed.

As illustrated in FIG. 25, the first terminal part 31 of the conductor 3 is fixed to the housing 2 by the fastening member 106 together with the terminal 105 of the first device 100. The fastening member 106 of the present embodiment is a bolt. The fastening member 106 is inserted into a through hole 105*a* of the terminal 105 and a through hole 31*a* of the first terminal part 31 and is screwed into the nut 21*a*. The first terminal part 31 and the terminal 105 are co-fastened by the fastening member 106 and electrically connected.

Furthermore, the connector 1 of the present embodiment has a first insertion structure 7 and a second insertion structure 8 as will be described with reference to FIG. 26. The connector 1 ensures a space distance and a creepage distance between the adjacent conductors 3 by the first insertion structure 7 and the second insertion structure 8. As illustrated in FIG. 26, the first insertion structure 7 and the second insertion structure 8 are disposed between the adjacent conductors 3. The first insertion structure 7 is composed of the housing 2 and the sealing member 4. The first insertion structure 7 has a first concave part 45 and a first insertion wall 27.

The first concave part 45 is a concave part provided in the sealing member 4. The first concave part 45 has a pair of first facing surfaces 46 and a first connection surface 47. The first facing surface 46 is the outer peripheral surface of the sealing part 40. The pair of first facing surfaces 46 face each other in the first direction X. The first connection surface 47 is a part of the second surface 41*b* of the connecting part 41. The first connection surface 47 connects base ends of the pair of first facing surfaces 46 along the first direction X. The first concave part 45 opened toward the housing 2 side is formed by the pair of first facing surfaces 46 and the first connection surface 47.

The first insertion wall 27 is an insertion wall provided in the housing 2. The first insertion wall 27 is a wall part that divides between the adjacent third recesses 24C. The first insertion wall 27 protrudes toward the sealing member 4 along the height direction Z. The first insertion wall 27 extends along the second direction Y so as to divide the adjacent conductors 3. The first insertion wall 27 is inserted into the first concave part 45. The first insertion wall 27 is inserted, for example, up to a position where the tip end surface of the first insertion wall 27 comes into contact with the first connection surface 47 or a position where the tip end surface of the first insertion wall 27 approaches the first connection surface 47. The first insertion structure 7 is designed such that the creepage distance between the adjacent conductors 3 becomes a desired distance.

The second insertion structure 8 is composed of the sealing member 4 and the support member 5. The second insertion structure 8 has a second concave part 57 and a second insertion wall 48. The second concave part 57 is a concave part provided in the support member 5. The second concave part 57 has a pair of second facing surfaces 58 and a second connection surface 59. The second facing surface 58 is the outer peripheral surface of the protrusion 52. The pair of second facing surfaces 58 face each other in the first direction X. The second connection surface 59 is a part of the outer surface 51*b* of the bottom wall part 51. The second connection surface 59 connects base ends of the pair of second facing surfaces 58 along the first direction X. The second concave part 57 opened toward the sealing member 4 is formed by the pair of second facing surfaces 58 and the second connection surface 59.

The second insertion wall 48 is an insertion wall provided in the sealing member 4. The second insertion wall 48 is a wall part that divides between the adjacent recesses 43. The second insertion wall 48 protrudes toward the support member 5 along the height direction Z. The second insertion wall 48 extends along the second direction Y so as to divide the adjacent conductors 3. The second insertion wall 48 is inserted into the second concave part 57. The second insertion wall 48 is inserted, for example, up to a position where the tip end surface of the second insertion wall 48 comes into contact with the second connection surface 59 or a position where the tip end surface of the second insertion wall 48 approaches the second connection surface 59. The second insertion structure 48 is designed such that the creepage distance between the adjacent conductors 3 becomes a desired distance.

As described above, the connector 1 of the present embodiment has the insulating housing 2, the conductors 3, the insulating sealing member 4, and the insulating support member 5. The housing 2 is fixed to the casing 101 of the first device 100 at the communication part 10 through which the opening 101*b* of the casing 101 of the first device 100 and the opening 201*b* of the casing 201 of the second device 200 communicate with each other. The housing 2 has the first through holes 25 that allow the internal space 102 of the first device 100 and the internal space 202 of the second device 200 to communicate with each other.

The conductors 3 are inserted into the first through holes 25, to electrically connect the first device 100 and the second device 200. The sealing member 4 has the annular sealing parts 40 that seal between the conductors 3 and the housing 2 and the connecting part 41 that connects the sealing parts 40. The support member 5 has the second through holes 54 into which the conductors 3 are inserted, and is attached to the housing 2 from the second device 200 side. The support member 5 interposes the sealing member 4 between the support member 5 and the housing 2 to support the sealing parts 40.

The housing 2 and the sealing member 4 have the first fitting structure 61 in which they are fitted to each other along the axial direction of the conductor 3. The sealing member 4 and the support member 5 have the second fitting structure 62 in which they are fitted to each other along the axial direction of the conductor 3. The connector 1 of the present embodiment can be assembled by at least the following two assembling methods. The first assembling method is a method in which the housing 2 and the sealing member 4 are fitted by the first fitting structure 61 to form a first assembly and another member is assembled to the first assembly. In such a case, the another member is at least one of the conductor 3 and the support member 5.

The second assembling method is a method in which the sealing member 4 and the support member 5 are fitted by the second fitting structure 62 to form a second assembly and the second assembly is assembled to the housing 2. The second assembly may further include the conductor 3. According to the connector 1 of the present embodiment, it is possible to select an arbitrary assembling method from a plurality of assembling methods according to work environments and operators. Thus, the connector 1 of the present embodiment can improve the efficiency of assembly work.

The connecting part 41 of the present embodiment has the annular frame part 41*c* that surrounds the conductors 3. The first fitting structure 61 has the frame part 41*c* and the second recess 24B provided in the housing 2 and fitted to the frame part 41*c*. The frame part 41*c* serves as an element of the second fitting structure 62, so that the complication of the shape of the sealing member 4 is suppressed. The frame part 41*c* is fitted into the second recess 24B, so that the deformation of the connecting part 41 and the sealing parts 40 is suppressed.

The second fitting structure 62 of the present embodiment has the recesses 43 provided in the connecting part 41 and the protrusions 52 provided in the support member 5 and fitted into the recesses 43 of the connecting part 41. The protrusions 52 support the sealing parts 40 of the sealing member 4. Thus, the protrusions 52 suitably suppress the movement and deformation of the sealing parts 40. The protrusions 52 are fitted into the recesses 43, so that the deformation and movement of the connecting part 41 is restricted.

First Modified Example of Embodiment

Figure 27:
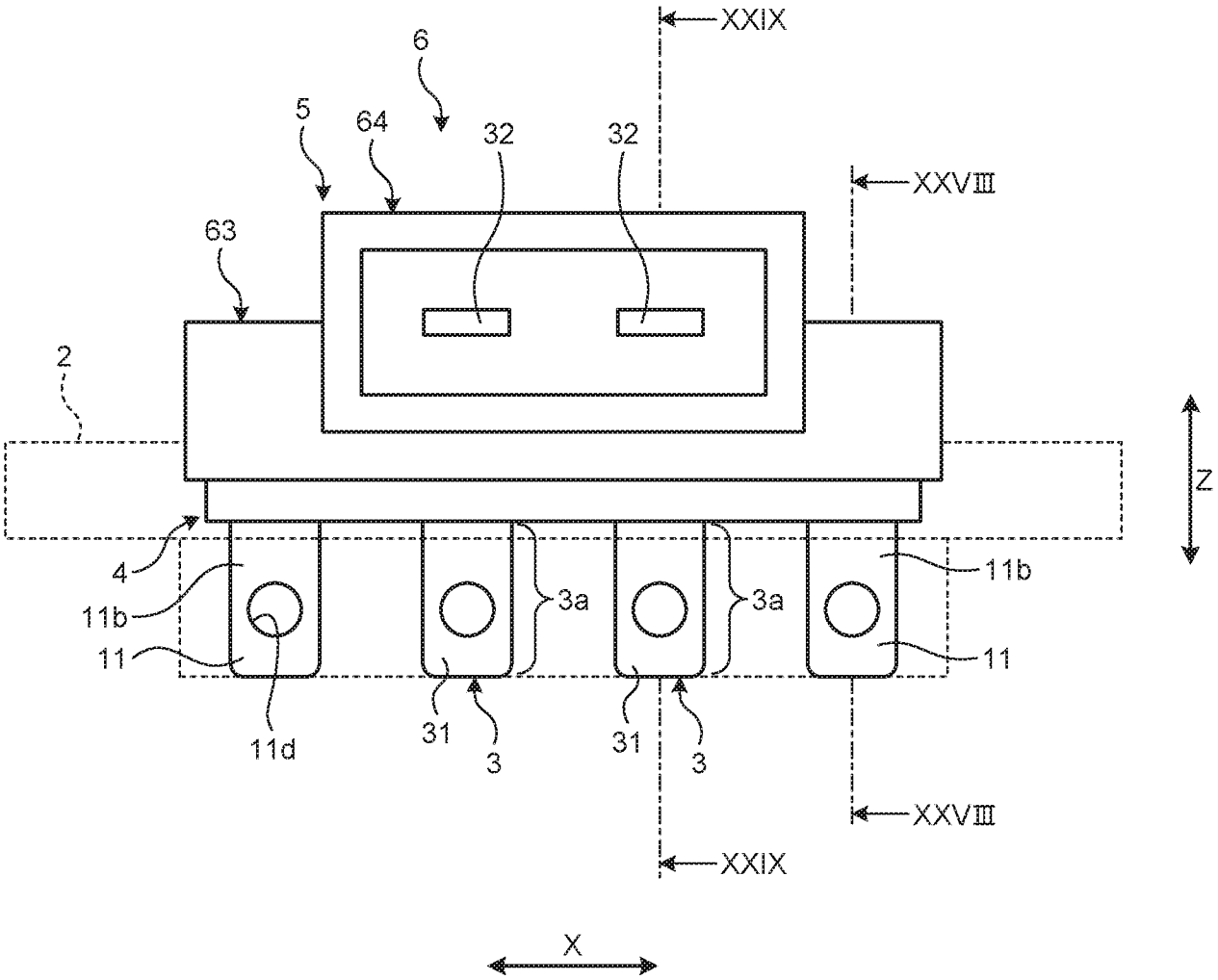
FIG. 27 is a front view of a conductor unit according to a first modified example of the embodiment.
Figure 28:
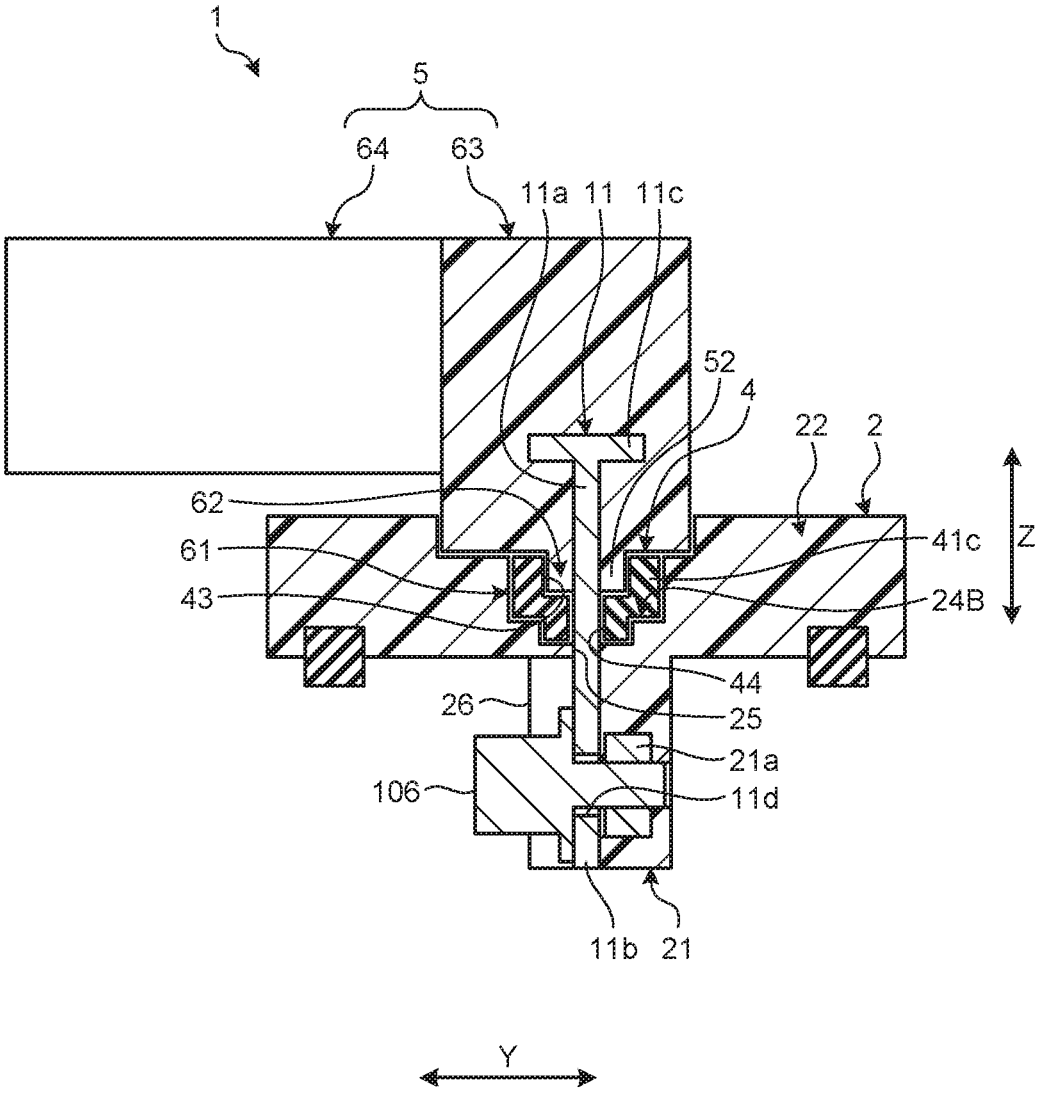
FIG. 28 is a sectional view of a connector according to the first modified example of the embodiment.
Figure 29:
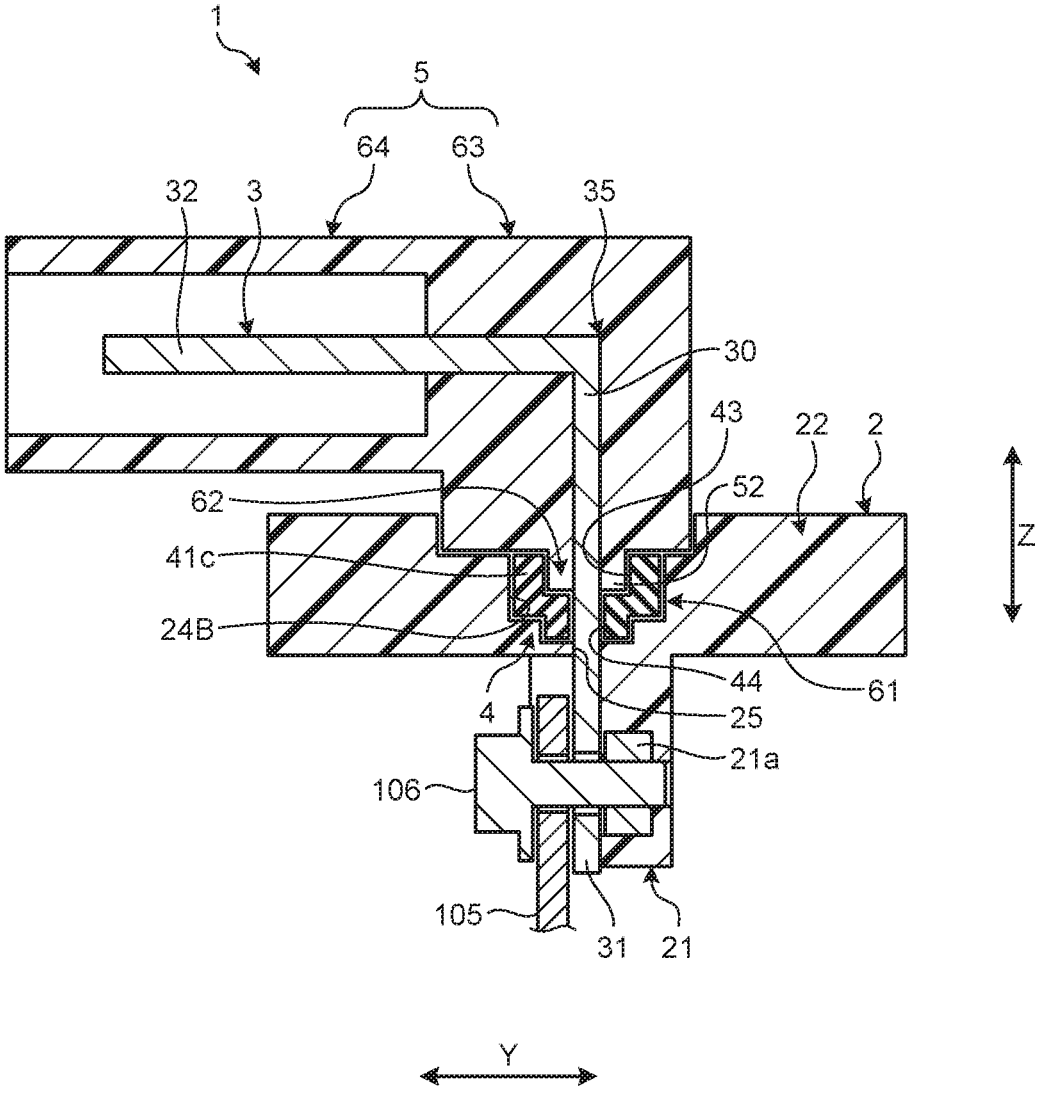
FIG. 29 is another sectional view of the connector according to the first modified example of the embodiment.
Figure 30:
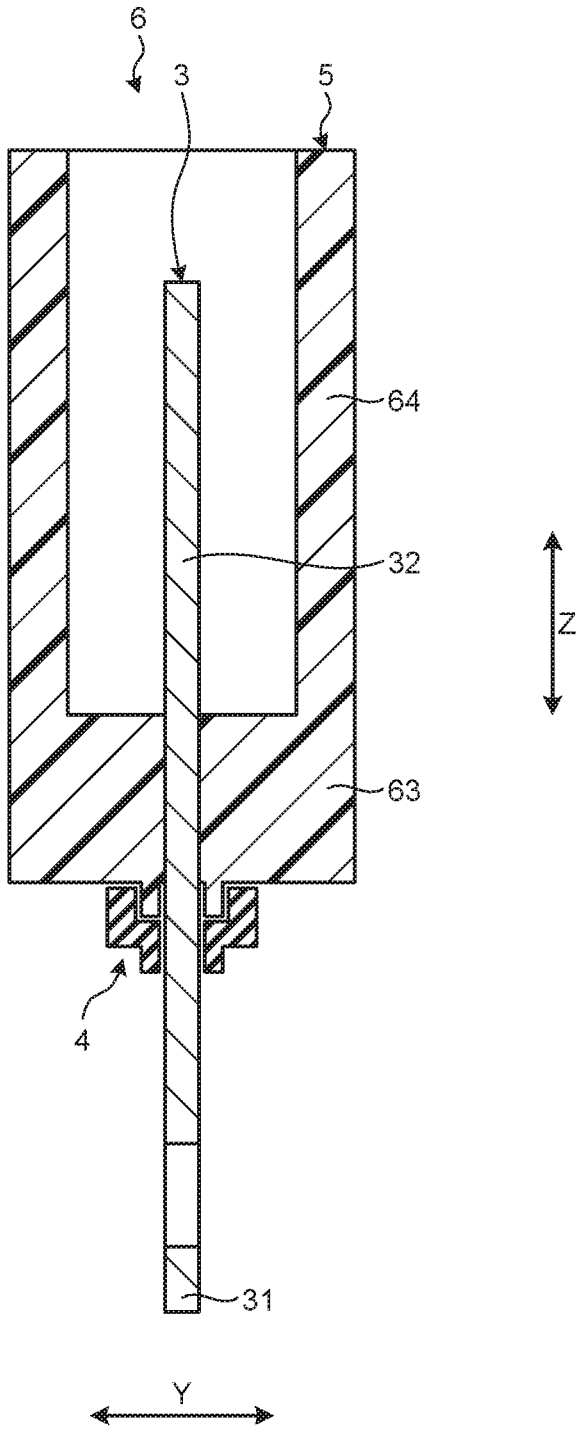
FIG. 30 is a sectional view of another conductor unit according to the first modified example of the embodiment.
Figure 31:
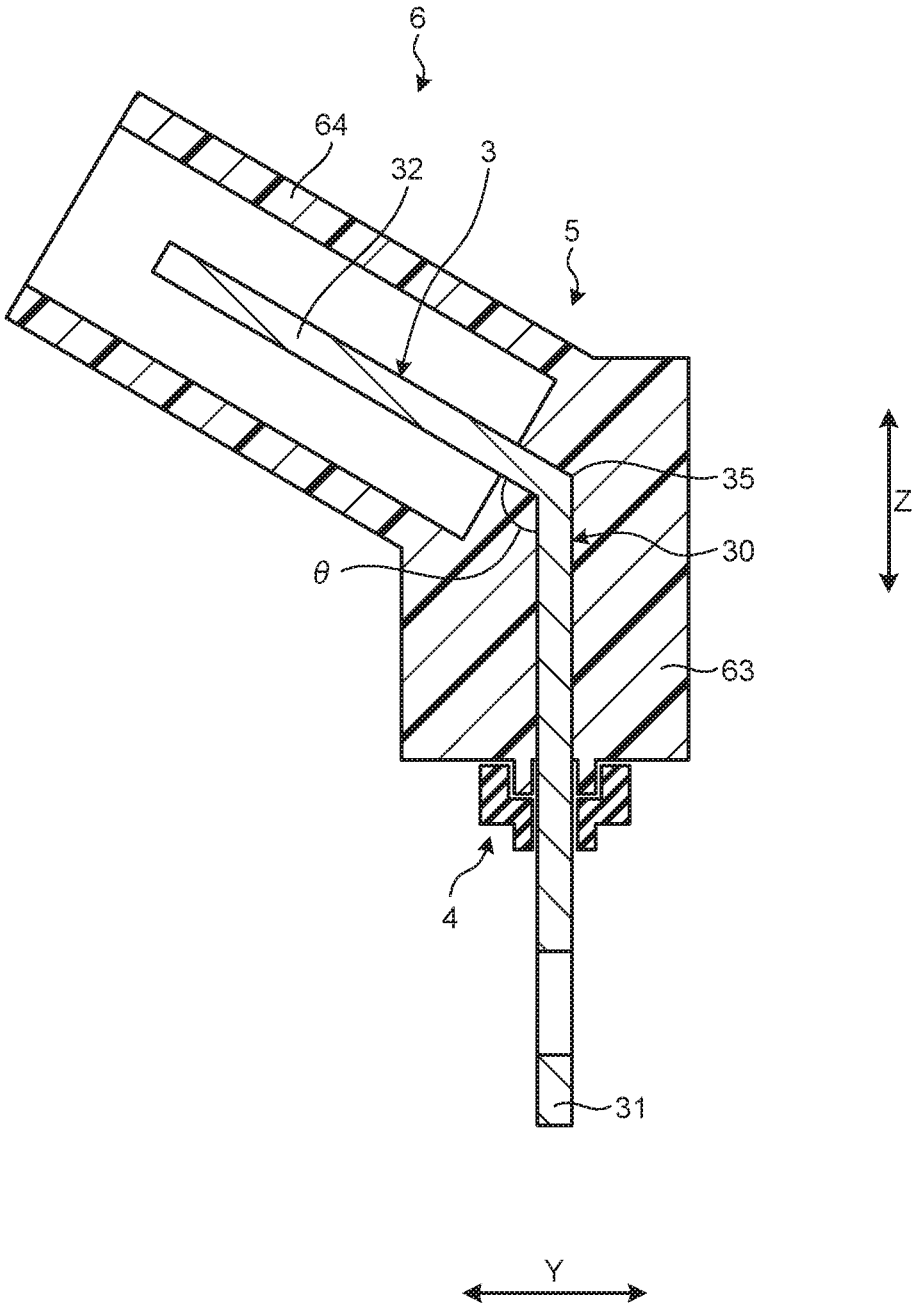
FIG. 31 is a sectional view of further another conductor unit according to the first modified example of the embodiment.

The first modified example of the embodiment will be described. FIG. 27 is a front view of a conductor unit according to the first modified example of the embodiment, FIG. 28 is a sectional view of a connector according to the first modified example of the embodiment, FIG. 29 is another sectional view of the connector according to the first modified example of the embodiment, FIG. 30 is a sectional view of another conductor unit according to the first modified example of the embodiment, and FIG. 31 is a sectional view of further another conductor unit according to the first modified example of the embodiment. FIG. 28 illustrates a section taken along line XXVIII-XXVIII of FIG. 27. FIG. 29 illustrates a section taken along line XXIX-XXIX of FIG. 27.

In the connector 1 according to the first modified example of the embodiment, the housing 2 and the sealing member 4 are made common to a plurality of types of conductor units 6. The housing 2 and the sealing member 4 can correspond to the conductor unit 6 illustrated in FIG. 19 and also correspond to the conductor unit 6 to be described with reference to FIG. 27 to FIG. 31.

The conductor unit 6 illustrated in FIG. 27 is different from the conductor unit 6 of the aforementioned embodiment in that metal plates 11 are provided instead of the conductors 3 at both ends. The conductor unit 6 illustrated in FIG. 27 is used when the connector 1 is configured as a two-pole connector. The metal plates 11 are fixed to the housing 2 by the fastening member 106. That is, the support member 5 and the housing 2 are connected via the metal plates 11. As a comparative example with respect to the conductor unit 6 illustrated in FIG. 27, a configuration, in which the metal plates 11 are not provided and the housing 2 and the support member 5 are connected by two conductors 3, is studied. The conductor unit 6 illustrated in FIG. 27 has a larger holding force between the housing 2 and the support member 5 than in the comparative example. Thus, the holding force of holding the support member 5 is improved with respect to stress when a matching connector is inserted into and removed from the connector 1.

The conductor unit 6 illustrated in FIG. 27 has the conductors 3, the sealing member 4, the support member 5, and the metal plates 11. By assembling the conductor unit 6 to the housing 2, the connector 1 illustrated in FIG. 28 and FIG. 29 is configured. The connector 1 illustrated in FIG. 28 and FIG. 29 has the housing 2, the conductors 3, the sealing member 4, the support member 5, and the metal plates 11.

The conductor 3 illustrated in FIG. 27 to FIG. 29 is a plate-shaped member, and is bent at the center thereof. More specifically, the body 30 of the conductor 3 has a bent part 35 bent at a substantially right angle.

The support member 5 has a body 63 and a tubular part 64. The body 63 and the tubular part 64 are integrally molded of an insulating synthetic resin. Furthermore, the support member 5 is integrally formed with the conductor 3 and the metal plates 11 by molding. The body 63 has a substantially rectangular parallelepiped shape. The longitudinal direction of the body 63 is the first direction X. The tubular part 64 protrudes from the body 63 toward the second direction Y. The tubular part 64 is opened toward the second direction Y and receives a housing and a terminal of a matching connector.

The first terminal part 31 of the conductor 3 protrudes from the body 63 toward the height direction Z. The second terminal part 32 of the conductor 3 protrudes from the body 63 toward the second direction Y. The second terminal part 32 protrudes into an internal space of the tubular part 64 and is received in the internal space of the tubular part 64. The second terminal part 32 is, for example, a tab terminal. The second terminal part 32 is inserted into a female terminal of the matching connector. The second terminal part 32 is interposed and held by a spring of the female terminal of the matching connector.

As illustrated in FIG. 28, the metal plate 11 is fixed to the body 63 of the support member 5 and protrudes from the body 63 along the height direction Z. The metal plate 11 has a base end part 11*a* and a tip end part 11*b*. The base end part 11*a* is a part fixed to the body 63. The base end part 11*a* has an extension part 11*c* extending toward a direction orthogonal to the height direction Z. The base end part 11*a* is integrally formed with the body 63 by molding and is fixed to the body 63.

The tip end part 11*b* is a part protruding from the body 63. The tip end part 11*b* has a flat plate shape. The tip end part 11*b* has a through hole 11*d*. The shape of the tip end part 11*b* is substantially the same as that of a corresponding part of the conductor 3. As illustrated in FIG. 27, the connector 1 of the present embodiment has two conductors 3 and two metal plates 11. The conductors 3 and the metal plates 11 are disposed at equal intervals along the first direction X. The two conductors 3 are disposed at the center in the first direction X. The two metal plates 11 are disposed at both ends in the first direction X. That is, the two metal plates 11 are disposed to interpose the two conductors 3 therebetween.

The shape of the tip end part 11*b* is substantially the same as that of a part 3*a* of the conductor 3, which protrudes from the body 63. That is, the shape and arrangement of the metal plates 11 are such that the four-pole sealing member 4 and the housing 2 can be used as they are.

As illustrated in FIG. 28, the tip end part 11*b* of the metal plate 11 is inserted into the through hole 44 of the sealing member 4 and the first through hole 25 of the housing 2. The tip end part 11*b* is fixed to the nut 21*a* of the housing 2 by the fastening member 106.

The conductor 3 is inserted into the sealing member 4 and the housing 2 as in the aforementioned embodiment. That is, as illustrated in FIG. 29, the conductor 3 is inserted into the through hole 44 of the sealing member 4 and the first through hole 25 of the housing 2. The first terminal part 31 is fixed to the nut 21*a* of the housing 2 by the fastening member 106 together with the terminal 105 of the first device 100.

Note that the connector 1 according to the first modified example of the embodiment has the first fitting structure 61 and the second fitting structure 62 as in the aforementioned embodiment, as illustrated in FIG. 28 and FIG. 29. Accordingly, the sealing member 4 can be attached to the housing 2 after being attached to the support member 5. Furthermore, the sealing member 4 can also be first attached to the housing 2 and then the support member 5 can be attached to the housing 2 and the sealing member 4.

Note that the connector 1 may have a conductor unit 6 illustrated in FIG. 30 or a conductor unit 6 illustrated in FIG. 31, instead of the conductor unit 6 illustrated in FIG. 27. The conductor unit 6 illustrated in FIG. 30 has a linear conductor 3. A support member 5 illustrated in FIG. 30 has a body 63 and a tubular part 64. The tubular part 64 protrudes from the body 63 along the height direction Z. The first terminal part 31 of the conductor 3 protrudes from the body 63 toward one side in the height direction Z. The second terminal part 32 protrudes from the body 63 toward the other side in the height direction Z. The second terminal part 32 protrudes into an internal space of the tubular part 64 and is received in the internal space of the tubular part 64.

The conductor 3 of the conductor unit 6 illustrated in FIG. 31 has a second terminal part 32 inclined in an oblique direction. The body 30 of the conductor 3 has a bent part 35. An angle θ of the bent part 35 is an obtuse angle. A support member 5 has a body 63 and a tubular part 64. The tubular part 64 protrudes from the body 63 toward a direction inclined with respect to both the height direction Z and the second direction Y. The first terminal part 31 of the conductor 3 protrudes from the body 63 toward the height direction Z. The second terminal part 32 protrudes from the body 63 toward the direction inclined with respect to both the height direction Z and the second direction Y. The second terminal part 32 protrudes into an internal space of the tubular part 64 and is received in the internal space of the tubular part 64.

As described above, the connector 1 according to the first modified example of the embodiment has the metal plates 11 fixed to the support member 5. The conductors 3 are inserted into some first through holes 25 of the plurality of first through holes 25. The metal plates 11 are inserted into the first through holes 25 different from the first through holes 25 into which the conductors 3 are inserted. In the conductor 3, the first terminal part 31 protruding from the first through hole 25 is fixed to the housing 2 by the fastening member 106 together with the terminal 105 of the first device 100. In the metal plate 11, the tip end part 11*b* protruding from the first through hole 25 is fixed to the housing 2 by the fastening member 106. In the connector 1 according to the first modified example of the embodiment, the support member 5 and the housing 2 are connected via the metal plates 11. Thus, the support member 5 is held with an appropriate holding force against stress when a matching connector is inserted into and removed from the conductors 3 and the support member 5.

Note that the number and arrangements of the conductors 3 and the metal plates 11 are not limited to the illustrated number and arrangements. For example, the number of the conductors 3 is not limited to two. The number of the metal plates 11 is not limited to two. The metal plates 11 may also be disposed at the center in the first direction X. In such a case, the conductors 3 may also be disposed to interpose the metal plates 11 therebetween.

Second Modified Example of Embodiment

The number and shape of the conductors 3 are not limited to the number and shape illustrated in the embodiment. For example, the shape of the conductor 3 may be a shape such as a pin having a circular section. The shapes of the housing 2, the sealing member 4, and the support member 5 are appropriately designed according to the shape of the conductor 3. When a pin having a circular section is used as the conductor 3, the sectional shapes of the first through hole 25 and the second through hole 54 are circular. Furthermore, the sectional shape of the sealing part 40 of the sealing member 4 is circular. The use of the conductor 3 is not limited to a power supply line that supplies electric power, and may be a signal line.

The shape of the sealing part 40 is not limited to the illustrated shape. Furthermore, the sealing part 40 is not limited to the shaft seal and may be a face seal.

The connector 1 may have a plurality of support members 5. For example, the connector 1 may have as many support members 5 as the number of the conductors 3. The insulating wall 53 may be provided on a member different from the support member 5. In other words, adjacent conductors 3 may be divided by a member different from the support member 5.

The shapes and arrangements of the first fitting structure 61 and the second fitting structure 62 are not limited to the illustrated shapes and arrangements. For example, in the first fitting structure 61, the housing 2 side may be convex, and the sealing member 4 side may be concave. In the second fitting structure 62, the sealing member 4 side may be convex and the support member 5 may be concave.

The first device 100 is not limited to the motor and the second device 200 is not limited to the inverter. Furthermore, the first liquid 104 is not limited to the oil and the second liquid 205 is not limited to the cooling water.

The contents disclosed in the aforementioned embodiment and modified examples can be combined and implemented as appropriate.

In the connector according to the present embodiment, the housing and the sealing member have the first fitting structure in which they are fitted to each other along the axial direction of the conductor, and the sealing member and the support member have the second fitting structure in which they are fitted to each other along the axial direction of the conductor. That is, the sealing member can be attached to both the housing and the support member. Thus, in accordance with the connector according to the present embodiment, it is possible to employ the most efficient assembling method from a plurality of assembling methods, thereby obtaining an effect to be able to improve the efficiency of assembly work.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

an insulating housing that is fixed to a casing of a first device at a communication part through which an opening of the casing of the first device and an opening of a casing of a second device communicate with each other, and includes a plurality of first through holes that allow an internal space of the first device and an internal space of the second device to communicate with each other;

a plurality of conductors that are inserted into the first through holes, to electrically connect the first device and the second device;

an insulating sealing member that includes a plurality of annular sealing parts that seal between the conductors and the housing, and a connecting part that connects the sealing parts; and an insulating support member that includes second through holes into which the conductors are inserted, is attached to the housing from a side of the second device, and interposes the sealing member between the support member and the housing to support the sealing parts, wherein the housing and the sealing member have a first fitting structure in which the housing and the sealing member are fitted to each other along an axial direction of the conductor, and the sealing member and the support member have a second fitting structure in which the sealing member and the support member are fitted to each other along the axial direction of the conductor.

2. The connector according to claim 1, wherein the connecting part has an annular frame part that surrounds the conductors, and the first fitting structure has the frame part and a recess provided in the housing and fitted to the frame part.

3. The connector according to claim 1, wherein the second fitting structure has recesses provided in the connecting part and protrusions provided in the support member and fitted into the recesses of the connecting part, and the protrusions support the sealing parts.

4. The connector according to claim 2, wherein the second fitting structure has recesses provided in the connecting part and protrusions provided in the support member and fitted into the recesses of the connecting part, and the protrusions support the sealing parts.

5. The connector according to claim 1, further comprising:

metal plates fixed to the support member, wherein the conductors are inserted into some first through holes of the plurality of first through holes, the metal plates are inserted into the first through holes different from the first through holes into which the conductors are inserted, in each of the conductors, a part protruding from the first through hole is fixed to the housing by a fastening member together with a terminal of the first device, and in each of the metal plates, a part protruding from the first through hole is fixed to the housing by a fastening member.

6. The connector according to claim 2, further comprising:

metal plates fixed to the support member, wherein the conductors are inserted into some first through holes of the plurality of first through holes, the metal plates are inserted into the first through holes different from the first through holes into which the conductors are inserted, in each of the conductors, a part protruding from the first through hole is fixed to the housing by a fastening member together with a terminal of the first device, and in each of the metal plates, a part protruding from the first through hole is fixed to the housing by a fastening member.

7. The connector according to claim 3, further comprising:

metal plates fixed to the support member, wherein the conductors are inserted into some first through holes of the plurality of first through holes, the metal plates are inserted into the first through holes different from the first through holes into which the conductors are inserted, in each of the conductors, a part protruding from the first through hole is fixed to the housing by a fastening member together with a terminal of the first device, and in each of the metal plates, a part protruding from the first through hole is fixed to the housing by a fastening member.

* * * * *